US011291268B2

(12) United States Patent
Wardlaw et al.

(10) Patent No.: US 11,291,268 B2
(45) Date of Patent: Apr. 5, 2022

(54) SPORTS SHOE AND METHOD FOR THE MANUFACTURE THEREOF

(71) Applicant: adidas AG, Herzogenaurach (DE)

(72) Inventors: Angus Wardlaw, Herzogenaurach (DE); Zachary Clinton Coonrod, Herzogenaurach (DE); James Tarrier, Herzogenaurach (DE); Heiko Schlarb, Herzogenaurach (DE); Paul Leonard Michael Smith, Herzogenaurach (DE); Warren Freeman, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 640 days.

(21) Appl. No.: 15/093,233

(22) Filed: Apr. 7, 2016

(65) Prior Publication Data

US 2016/0295955 A1 Oct. 13, 2016

(30) Foreign Application Priority Data

Apr. 10, 2015 (DE) ..... 102015206486.7

(51) Int. Cl.

| | |
|---|---|
| ***A43B 7/28*** | (2006.01) |
| ***A43C 1/00*** | (2006.01) |
| ***A43B 9/00*** | (2006.01) |
| ***A43B 23/02*** | (2006.01) |
| ***A43B 13/14*** | (2006.01) |
| ***A43B 5/06*** | (2006.01) |

(52) U.S. Cl.

CPC ..... *A43B 7/28* (2013.01); *A43B 5/06* (2013.01); *A43B 9/00* (2013.01); *A43B 13/141* (2013.01); *A43B 23/0205* (2013.01); *A43B 23/0245* (2013.01); *A43C 1/00* (2013.01)

(58) Field of Classification Search

CPC .... A43B 7/27; A43B 5/06; A43B 9/00; A43B 7/28; A43B 7/00

USPC ..... 36/93

See application file for complete search history.

(56) References Cited

U.S. PATENT DOCUMENTS

| | | | |
|---|---|---|---|
| D64,898 | S | 6/1924 | Gunlock |
| 2,131,756 | A | 10/1938 | Roberts |
| D174,987 | S | 6/1955 | Gillis |
| 2,968,106 | A | 1/1961 | Joiner et al. |
| D199,427 | S | 10/1964 | Weiner |

(Continued)

FOREIGN PATENT DOCUMENTS

| | | |
|---|---|---|
| CN | 1034662 | 8/1989 |
| CN | 1036128 | 10/1989 |

(Continued)

OTHER PUBLICATIONS

"https://www.britannica.com/print/article/463684", Aug. 17, 2016, 15 pgs.

(Continued)

*Primary Examiner* — Alissa J Tompkins
*Assistant Examiner* — Catherine M Ferreira
(74) *Attorney, Agent, or Firm* — Kilpatrick Townsend & Stockton LLP

(57) ABSTRACT

A shoe, in particular a running shoe, may include an upper and a sole unit. The upper is attached to the sole unit such that in a midfoot region there is a gap between a lower side of the upper and a top side of the sole unit. The gap may extend from a lateral side of the shoe to a medial side of the shoe.

20 Claims, 12 Drawing Sheets

(56) References Cited

U.S. PATENT DOCUMENTS 3,186,013 A 6/1965 Glassman et al.
3,586,003 A 6/1971 Baker
D237,323 S 10/1975 Inohara
4,132,016 A 1/1979 Vaccari
4,364,189 A 12/1982 Bates
4,481,727 A 11/1984 Stubblefield et al.
4,524,529 A 6/1985 Schaefer
4,546,559 A 10/1985 Dassler et al.
4,624,062 A 11/1986 Autry
4,642,911 A 2/1987 Talarico et al.
4,658,515 A 4/1987 Oatman et al.
4,667,423 A 5/1987 Autry et al.
D296,262 S 6/1988 Brown et al.
4,754,561 A 7/1988 Dufour
D302,898 S 8/1989 Greenberg
RE33,066 E 9/1989 Stubblefield
4,864,739 A 9/1989 Maestri
4,922,631 A 5/1990 Anderie
4,970,807 A 11/1990 Anderie et al.
4,980,445 A 12/1990 van Der wal et al.
5,025,573 A 6/1991 Giese et al.
D329,731 S 9/1992 Adcock et al.
5,150,490 A 9/1992 Busch et al.
D333,556 S 3/1993 Purdom
D337,650 S 7/1993 Thomas, III et al.
D340,797 S 11/1993 Pallera et al.
5,283,963 A 2/1994 Lerner et al.
5,308,420 A 5/1994 Yang et al.
5,319,866 A 6/1994 Foley et al.
D350,016 S 8/1994 Passke et al.
D350,222 S 9/1994 Hase
5,353,523 A * 10/1994 Kilgore ..... A43B 13/183 36/28
D356,438 S 3/1995 Opie et al.
5,549,743 A 8/1996 Pearce
D375,619 S 11/1996 Backus et al.
5,617,650 A 4/1997 Grim
5,692,319 A 12/1997 Parker et al.
5,709,954 A 1/1998 Lyden et al.
D389,991 S 2/1998 Elliott
D390,349 S 2/1998 Murai et al.
D393,340 S 4/1998 Doxey
D395,337 S 6/1998 Greene
D408,618 S 4/1999 Wilborn et al.
D408,971 S 5/1999 Birkenstock
D413,010 S 8/1999 Birkenstock
5,932,336 A 8/1999 Petrovic et al.
5,933,985 A 8/1999 James
D414,920 S 10/1999 Cahill
D415,610 S 10/1999 Cahill
D415,876 S 11/1999 Cahill
5,996,252 A 12/1999 Cougar
6,014,821 A 1/2000 Yaw
6,041,521 A 3/2000 Wong
D422,400 S 4/2000 Brady et al.
D423,199 S 4/2000 Cahill
6,076,284 A 6/2000 Terlizzi
6,108,943 A 8/2000 Hudson
D431,346 S 10/2000 Birkenstock
D460,852 S 7/2002 Daudier
6,505,424 B2 * 1/2003 Oorei ..... A43B 5/00 36/129
6,516,540 B2 2/2003 Seydel et al.
6,634,121 B2 10/2003 Sordy
6,702,469 B1 3/2004 Taniguchi et al.
D490,222 S 5/2004 Burg et al.
D490,230 S 5/2004 Mervar
D492,099 S 6/2004 McClaskie
6,782,640 B2 8/2004 Westin et al.
6,796,056 B2 9/2004 Swigart
D498,901 S 11/2004 Hawker et al.
6,849,667 B2 2/2005 Haseyama et al.
6,874,257 B2 4/2005 Erickson
6,925,734 B1 8/2005 Schaeffer et al.
6,944,972 B2 * 9/2005 Schmid ..... A43B 13/12 36/27
6,948,263 B2 9/2005 Covatch
6,957,504 B2 10/2005 Morris
D511,887 S 11/2005 Jean-Poix et al.
D517,302 S 3/2006 Ardissono
7,073,277 B2 7/2006 Erb et al.
D528,768 S 9/2006 Teague
D528,772 S 9/2006 Portzline
7,143,529 B2 12/2006 Robinson et al.
D538,518 S 3/2007 Della Valle
7,202,284 B1 4/2007 Limerkens et al.
D554,848 S 11/2007 Marston
D560,883 S 2/2008 McClaskie
D561,433 S 2/2008 McClaskie
D561,438 S 2/2008 Belley
D561,986 S 2/2008 Horne et al.
D570,581 S 6/2008 Polegato
D571,085 S 6/2008 McClaskie
D572,462 S 7/2008 Hatfield et al.
7,421,805 B2 9/2008 Geer
7,428,789 B2 * 9/2008 Holzer ..... A43B 5/0411 36/117.2
D586,090 S 2/2009 Turner et al.
D589,690 S 4/2009 Truelsen
D594,187 S 6/2009 Hickman
D596,384 S 7/2009 Andersen et al.
D601,333 S 10/2009 McClaskie
D606,733 S 12/2009 McClaskie
D607,190 S 1/2010 McClaskie
D611,233 S 3/2010 Della Valle et al.
7,673,397 B2 3/2010 Jarvis
7,676,960 B2 * 3/2010 DiBenedetto ..... A43B 1/0054 36/132
D614,390 S 4/2010 Petrie
D616,183 S 5/2010 Skaja
D617,540 S 6/2010 McClaskie
D618,891 S 7/2010 McClaskie
D626,739 S 11/2010 Ho
D631,646 S 2/2011 Muller
D633,286 S 3/2011 Skaja
D633,287 S 3/2011 Skaja
D634,918 S 3/2011 Katz et al.
D636,156 S 4/2011 Della Valle et al.
D636,569 S 4/2011 McMillan
D636,571 S 4/2011 Avar
7,941,941 B2 5/2011 Hazenberg et al.
D641,142 S 7/2011 Lindseth et al.
D641,968 S 7/2011 Miner
D644,827 S 9/2011 Lee
D645,649 S 9/2011 McClaskie
D648,105 S 11/2011 Schlageter et al.
D650,159 S 12/2011 Avar
8,082,684 B2 12/2011 Munns
D655,488 S 3/2012 Blakeslee
D659,364 S 5/2012 Jolicoeur
8,186,081 B2 5/2012 Wilson, III
8,356,426 B1 * 1/2013 Daniel ..... A43B 13/36 36/15
D680,725 S 4/2013 Avar et al.
D680,726 S 4/2013 Propét
D683,116 S 5/2013 Petrie
8,479,412 B2 7/2013 Peyton et al.
8,490,297 B2 7/2013 Guerra
D693,553 S 11/2013 McClaskie
D695,501 S 12/2013 Yehudah
D698,137 S 1/2014 Carr
8,661,714 B2 * 3/2014 Sussmann ..... A43B 3/24 36/102
D707,934 S 7/2014 Petrie
D709,680 S 7/2014 Herath
8,834,770 B2 9/2014 Nakano et al.
D721,478 S 1/2015 Avent et al.
9,010,157 B1 4/2015 Podhajny et al.
D739,129 S 9/2015 Del Biondi
D739,131 S 9/2015 Del Biondi
D740,003 S 10/2015 Herath
D740,004 S 10/2015 Hoellmueller et al.
9,212,270 B2 12/2015 Künkel et al.

(56) References Cited

U.S. PATENT DOCUMENTS

D758,056 S 6/2016 Galway et al.
D776,410 S 1/2017 Herath et al.
D783,264 S 4/2017 Hoellmueller et al.
9,610,746 B2 4/2017 Wardlaw et al.
9,675,130 B2 * 6/2017 Ueda ..... A43B 1/14
9,675,624 B2 * 6/2017 Ignar ..... A61K 9/0043
D793,699 S 8/2017 Petrenka
9,781,970 B2 10/2017 Angus et al.
9,781,974 B2 10/2017 Reinhardt
9,788,598 B2 10/2017 Reinhardt
9,788,606 B2 10/2017 Reinhardt
D803,541 S 11/2017 Jury et al.
9,820,528 B2 11/2017 Reinhardt et al.
9,849,645 B2 12/2017 Wardlaw et al.
D814,167 S 4/2018 Cooke et al.
D815,421 S 4/2018 Sokol
D815,422 S 4/2018 Hobson
D828,686 S 9/2018 Hoellmueller et al.
D858,961 S 9/2019 Mace
2003/0131501 A1 7/2003 Erickson et al.
2003/0158275 A1 8/2003 McClelland et al.
2003/0172548 A1 9/2003 Fuerst
2003/0208925 A1 11/2003 Pan
2004/0032042 A1 2/2004 Chi
2004/0107601 A1 * 6/2004 Schmid ..... A43B 13/12 36/28
2004/0118016 A1 * 6/2004 Tonkel ..... A43B 23/25 36/11.5
2004/0138318 A1 7/2004 McClelland et al.
2004/0181972 A1 9/2004 Csorba et al.
2004/0211088 A1 10/2004 Volkart
2005/0108898 A1 5/2005 Jeppesen et al.
2005/0138839 A1 6/2005 Terlizzi
2005/0150132 A1 7/2005 Iannacone
2005/0241181 A1 11/2005 Cheng
2006/0010717 A1 1/2006 Finkelstein et al.
2006/0026863 A1 2/2006 Liu
2006/0083912 A1 4/2006 Park et al.
2006/0125134 A1 6/2006 Lin et al.
2006/0134351 A1 6/2006 Greene et al.
2006/0156579 A1 7/2006 Hoffer et al.
2006/0235095 A1 10/2006 Leberfinger et al.
2006/0283046 A1 12/2006 Mason
2007/0193070 A1 8/2007 Bertagna et al.
2007/0199213 A1 8/2007 Campbell et al.
2007/0218714 A1 * 9/2007 Shaw ..... B63B 32/45 439/73
2007/0295451 A1 12/2007 Willis
2008/0052965 A1 3/2008 Sato et al.
2008/0060221 A1 3/2008 Hottinger et al.
2008/0244932 A1 10/2008 Nau et al.
2008/0250666 A1 10/2008 Votolato
2009/0013558 A1 1/2009 Hazenberg et al.
2009/0025260 A1 1/2009 Nakano
2009/0090027 A1 * 4/2009 Baudouin ..... A43B 7/1495 36/93
2009/0113758 A1 5/2009 Nishiwaki et al.
2009/0119023 A1 5/2009 Zimmer et al.
2009/0235557 A1 9/2009 Christensen et al.
2009/0277047 A1 11/2009 Polegato
2009/0320330 A1 12/2009 Borel et al.
2010/0063778 A1 3/2010 Schrock et al.
2010/0122472 A1 5/2010 Wilson, III et al.
2010/0154257 A1 * 6/2010 Bosomworth ..... A43B 13/10 36/30 R
2010/0218397 A1 * 9/2010 Nishiwaki ..... A43B 7/142 36/28
2010/0222442 A1 9/2010 Prissok et al.
2010/0242309 A1 9/2010 McCann
2010/0287788 A1 11/2010 Spanks et al.
2010/0287795 A1 11/2010 Van Niekerk
2010/0293811 A1 11/2010 Truelsen
2011/0047720 A1 3/2011 Maranan et al.
2011/0067272 A1 3/2011 Lin
2011/0203137 A1 8/2011 Long
2011/0232135 A1 9/2011 Dean et al.
2011/0252668 A1 10/2011 Chen
2011/0283560 A1 11/2011 Portzline et al.
2011/0302805 A1 12/2011 Vito
2012/0005920 A1 1/2012 Alvear et al.
2012/0047770 A1 3/2012 Dean et al.
2012/0059075 A1 3/2012 Prissok et al.
2012/0177777 A1 7/2012 Brown et al.
2012/0233877 A1 9/2012 Swigart
2012/0233883 A1 9/2012 Spencer et al.
2012/0235322 A1 9/2012 Greene et al.
2012/0266490 A1 10/2012 Atwal et al.
2013/0150468 A1 6/2013 Füssi et al.
2013/0255103 A1 10/2013 Dua et al.
2013/0266792 A1 10/2013 Nohara et al.
2013/0269215 A1 * 10/2013 Smirman ..... A43B 5/1641 36/102
2013/0291409 A1 11/2013 Reinhardt et al.
2014/0017450 A1 1/2014 Baghdadi et al.
2014/0033573 A1 2/2014 Wills
2014/0066530 A1 3/2014 Shen et al.
2014/0075779 A1 * 3/2014 Bruce ..... A43B 13/20 36/29
2014/0075787 A1 3/2014 Cartagena
2014/0197253 A1 7/2014 Lofts et al.
2014/0223673 A1 8/2014 Wardlaw et al.
2014/0223776 A1 8/2014 Wardlaw et al.
2014/0223777 A1 8/2014 Whiteman et al.
2014/0223783 A1 8/2014 Wardlaw et al.
2014/0227505 A1 8/2014 Schiller et al.
2014/0345162 A1 * 11/2014 Mitchell ..... A43B 1/0081 36/100
2014/0352173 A1 12/2014 Bell et al.
2014/0366403 A1 12/2014 Reinhardt et al.
2014/0366404 A1 12/2014 Reinhardt et al.
2014/0366405 A1 12/2014 Reinhardt et al.
2014/0373392 A1 12/2014 Cullen
2015/0082668 A1 3/2015 Nakaya et al.
2015/0089841 A1 4/2015 Smaldone et al.
2015/0166270 A1 6/2015 Buscher et al.
2015/0174808 A1 6/2015 Rudolph et al.
2015/0197617 A1 7/2015 Prissok et al.
2015/0201707 A1 * 7/2015 Bruce ..... A43B 23/04 36/47
2015/0237823 A1 8/2015 Schmitt et al.
2015/0305447 A1 * 10/2015 Cavaliere ..... A43B 5/02 36/66
2015/0344661 A1 12/2015 Spies et al.
2015/0351493 A1 12/2015 Ashcroft et al.
2016/0037859 A1 2/2016 Smith et al.
2016/0044992 A1 2/2016 Reinhardt et al.
2016/0046751 A1 2/2016 Spies et al.
2016/0121524 A1 5/2016 Däschlein et al.
2016/0128426 A1 5/2016 Reinhardt et al.
2016/0227876 A1 8/2016 Le et al.
2016/0242504 A1 * 8/2016 Cowley ..... A43B 13/36
2016/0244583 A1 8/2016 Keppeler
2016/0244584 A1 8/2016 Keppeler
2016/0244587 A1 8/2016 Gutmann et al.
2016/0278481 A1 9/2016 Le et al.
2016/0302508 A1 10/2016 Kormann et al.
2016/0346627 A1 12/2016 Le et al.
2017/0173910 A1 6/2017 Wardlaw et al.
2017/0253710 A1 9/2017 Smith et al.
2017/0259474 A1 9/2017 Holmes et al.
2017/0340067 A1 11/2017 Dyckmans et al.
2017/0341325 A1 11/2017 Le et al.
2017/0341326 A1 11/2017 Holmes et al.
2017/0341327 A1 11/2017 Le et al.
2018/0000197 A1 1/2018 Wardlaw et al.
2018/0035755 A1 2/2018 Reinhardt et al.
2018/0093437 A1 4/2018 Wardlaw et al.
2018/0103721 A1 * 4/2018 Mulholland ..... A43B 3/244
2018/0154598 A1 6/2018 Kurtz et al.
2018/0206591 A1 7/2018 Whiteman et al.
2018/0235310 A1 8/2018 Wardlaw et al.

(56) References Cited

U.S. PATENT DOCUMENTS

| | | | |
|---|---|---|---|
| 2018/0290349 | A1 | 10/2018 | Kirupanantham et al. |
| 2018/0303198 | A1 | 10/2018 | Reinhardt et al. |
| 2019/0082789 | A1 | 3/2019 | Smith et al. |

FOREIGN PATENT DOCUMENTS

| | | | |
|---|---|---|---|
| CN | 2511160 | | 9/2002 |
| CN | 2796454 | | 7/2006 |
| CN | 2888936 | | 4/2007 |
| CN | 101107113 | | 1/2008 |
| CN | 101190049 | | 6/2008 |
| CN | 201223028 | | 4/2009 |
| CN | 101484035 | | 7/2009 |
| CN | 101611950 | | 12/2009 |
| CN | 202233324 | | 5/2012 |
| CN | 202635746 | | 1/2013 |
| CN | 202907958 | | 5/2013 |
| CN | 103371564 | | 10/2013 |
| CN | 203692653 | | 7/2014 |
| CN | 203828180 | | 9/2014 |
| DE | 3605662 | | 6/1987 |
| DE | 4236081 | | 4/1994 |
| DE | 29718491 | | 2/1998 |
| DE | 19652690 | | 6/1998 |
| DE | 19950121 | | 11/2000 |
| DE | 10010182 | | 9/2001 |
| DE | 10244433 | | 12/2005 |
| DE | 10244435 | | 2/2006 |
| DE | 102004063803 | | 7/2006 |
| DE | 102005050411 | | 4/2007 |
| DE | 202008017042 | | 4/2009 |
| DE | 102008020890 | | 10/2009 |
| DE | 102009004386 | | 7/2010 |
| DE | 202010008893 | | 1/2011 |
| DE | 202010015777 | | 1/2011 |
| DE | 112009001291 | | 4/2011 |
| DE | 102010052783 | | 5/2012 |
| DE | 202012005735 | | 8/2012 |
| DE | 102011108744 | | 1/2013 |
| DE | 102012206094 | | 10/2013 |
| DE | 102013208170 | | 11/2014 |
| EM | 001286116-0001 | | 7/2011 |
| EM | 001286116-0002 | | 7/2011 |
| EM | 001286116-0003 | | 7/2011 |
| EM | 001286116-0004 | | 7/2011 |
| EM | 001286116-0005 | | 7/2011 |
| EM | 001286116-0006 | | 7/2011 |
| EP | 0165353 | | 12/1985 |
| EP | 752216 | | 1/1997 |
| EP | 873061 | | 10/1998 |
| EP | 1197159 | | 4/2002 |
| EP | 1424105 | | 6/2004 |
| EP | 1197159 | | 9/2004 |
| EP | 1854620 | | 11/2007 |
| EP | 1872924 | | 1/2008 |
| EP | 2110037 | A1 | 10/2009 |
| EP | 2233021 | | 9/2010 |
| EP | 2250917 | | 11/2010 |
| EP | 2316293 | | 5/2011 |
| EP | 2342986 | | 7/2011 |
| EP | 2446768 | | 5/2012 |
| EP | 2649896 | | 10/2013 |
| EP | 2540184 | B1 | 7/2014 |
| EP | 2792261 | A1 | 10/2014 |
| EP | 2848144 | | 3/2015 |
| EP | 2939558 | | 11/2015 |
| EP | 3067100 | | 9/2016 |
| ES | 1073997 | | 6/2011 |
| FR | 2683432 | | 5/1993 |
| GB | 2258801 | | 2/1993 |
| JP | S47-016630 | B | 5/1972 |
| JP | S61-092602 | A | 5/1986 |
| JP | S62-231602 | A | 10/1987 |
| JP | 01274705 | | 11/1989 |
| JP | 04502780 | | 5/1992 |
| JP | 6046483 | U | 6/1994 |
| JP | H10-137004 | A | 5/1998 |
| JP | 10152575 | | 6/1998 |
| JP | 2000197503 | | 7/2000 |
| JP | 2001046103 | | 2/2001 |
| JP | 2001-137001 | A | 5/2001 |
| JP | S35-003340 | Y | 5/2001 |
| JP | 2001-299404 | A | 10/2001 |
| JP | 2002361749 | | 12/2002 |
| JP | 2005218543 | | 8/2005 |
| JP | 2007516109 | | 6/2007 |
| JP | 2007-185353 | A | 7/2007 |
| JP | 2008073548 | | 4/2008 |
| JP | 2008543401 | | 12/2008 |
| JP | 3184409 | U | 6/2013 |
| JP | 2013532574 | | 8/2013 |
| JP | 2014-008298 | A | 1/2014 |
| JP | 2014-223220 | | 12/2014 |
| JP | 2015-002850 | | 1/2015 |
| KR | 1020110049293 | | 5/2011 |
| TW | 201012407 | | 4/2010 |
| WO | 8906501 | | 7/1989 |
| WO | 1994020568 | A1 | 9/1994 |
| WO | 2002/008322 | | 1/2002 |
| WO | 2005023920 | | 3/2005 |
| WO | 2005026243 | A1 | 3/2005 |
| WO | 2005038706 | | 4/2005 |
| WO | 2005066250 | | 7/2005 |
| WO | 2006015440 | | 2/2006 |
| WO | 2006027671 | | 3/2006 |
| WO | 2006/034807 | A1 | 4/2006 |
| WO | 2006090221 | | 8/2006 |
| WO | 2007082838 | | 7/2007 |
| WO | 2008047538 | A1 | 4/2008 |
| WO | 2008087078 | | 7/2008 |
| WO | 2009039555 | | 4/2009 |
| WO | 2009095935 | | 8/2009 |
| WO | 2010010010 | | 1/2010 |
| WO | 2010037028 | | 4/2010 |
| WO | 2010045144 | | 4/2010 |
| WO | 2010136398 | | 12/2010 |
| WO | 2011134996 | A1 | 11/2011 |
| WO | 2012065926 | | 5/2012 |
| WO | 2013013784 | | 1/2013 |
| WO | 2013168256 | | 11/2013 |
| WO | 2014046940 | | 3/2014 |
| WO | 2014/155511 | A1 | 10/2014 |
| WO | 2015038243 | | 3/2015 |
| WO | 2015052265 | A1 | 4/2015 |
| WO | 2015052267 | A1 | 4/2015 |
| WO | 2015075546 | A1 | 5/2015 |

OTHER PUBLICATIONS

"Colour and Additive Preparations for Extruded Polyolefin Foams", Gabriel-Chemie Group, available at www.gabriel-chemie.com/downloads/folder/PE%20foams_en.pdf, last accessed on Jan. 17, 2017, 20 pages.

"http://www.dow.com/polyethylene/na/en/fab/foaming.htm", Dec. 7, 2011, 1 page.

Nauta, "Stabilisation of Low Density, Closed Cell Polyethylene Foam", University of Twente, Netherlands, 2000, 148 pages.

Third Party Submission, U.S. Appl. No. 14/981,168, dated Nov. 14, 2016, 44 pages.

U.S. Appl. No. 15/703,031, Unpublished (Filed Sep. 13, 2017).

U.S. Appl. No. 15/724,318, Unpublished (filed Oct. 4, 2017).

U.S. Appl. No. 15/581,112, Unpublished (filed Apr. 28, 2017).

U.S. Appl. No. 29/591,016, Unpublished (filed Jan. 16, 2017).

U.S. Appl. No. 29/592,935, Unpublished (filed Feb. 3, 2017).

U.S. Appl. No. 29/592,946, Unpublished (filed Feb. 3, 2017).

U.S. Appl. No. 29/594,228, Unpublished (filed Feb. 16, 2017).

U.S. Appl. No. 29/594,358, Unpublished (filed Feb. 17, 2017).

U.S. Appl. No. 29/595,852, Unpublished (filed Mar. 2, 2017).

U.S. Appl. No. 29/595,857, Unpublished (filed Mar. 2, 2017).

U.S. Appl. No. 29/595,859, Unpublished (filed Mar. 2, 2017).

U.S. Appl. No. 29/614,532, Unpublished (filed Aug. 21, 2017).

(56) References Cited

OTHER PUBLICATIONS

U.S. Appl. No. 29/614,545, Unpublished (filed Aug. 21, 2017).
AZO Materials , “”BASF Develops Expanded Thermoplastic Polyurethane“, available http://www.azom.com/news.aspxNewsID=37360”, Jul. 2, 2013, 4 pages.
Office Action, Chinese Patent Application No. 201610217186.5, dated Jun. 22, 2017.
Office Action, Chinese Patent Application No. 201610217186.5, dated Jul. 3, 2018, 13 pages.
Office Action, Japanese Patent Application No. 20160066429, dated Nov. 27, 2018, 16 pages.
U.S. Appl. No. 29/664,097 Unpublished (filed Sep. 21, 2018).
U.S. Appl. No. 16/353,374, Unpublished (filed Mar. 14, 2019).
U.S. Appl. No. 29/663,342, Unpublished (Filed Sep. 13, 2018).
U.S. Appl. No. 29/643,233, Unpublished (Filed Apr. 5, 2018).
U.S. Appl. No. 29/641,371, Unpublished (filed Mar. 21, 2018).
U.S. Appl. No. 29/663,029, Unpublished (filed Sep. 11, 2018).
U.S. Appl. No. 29/641,256, Unpublished (filed Mar. 20, 2018).
U.S. Appl. No. 29/641,223, Unpublished (filed Mar. 20, 2018).
U.S. Appl. No. 16/139,797, Unpublished (Filed Sep. 24, 2018).
U.S. Appl. No. 29/679,962, Unpublished (filed Feb. 12, 2019).
Office Action, Japanese Patent Application No. 2016-066429, dated May 26, 2020, 11 pages.
Office Action, Japanese Patent Application No. 2016-066429, dated Sep. 8, 2020, 11 pages.
German Patent Application No. 102015206486.7, First Office Action dated Feb. 17, 2016, 8 pages (No English translation available. A summary of the Office Action Is provided in the Transmittal Letter submitted herewith).
U.S. Appl. No. 62/137,139, Gordon et al., Unpublished (Filed Mar. 23, 2016).
U.S. Appl. No. 29/550,418, Galway, Unpublished (Filed Jan. 4, 2016).
U.S. Appl. No. 29/558,138, Hoellmueller et al., Unpublished (Filed Mar. 15, 2016).
U.S. Appl. No. 15/078,043, Tru, Unpublished (Filed Mar. 23, 2016).
U.S. Appl. No. 15/130,012, Kormann et al., Unpublished (Filed Apr. 15, 2016).
Amesöder et al., “The right turn (part 1)—Determination of Characteristic values for assembly injection”, Journal of Plastics Technology, Apr. 2008, pp. 1-8 (EnglishTranslation of Abstract provided).
Baur et al., “Saechtling Kunststoff Taschenbuch”, Hanser Verlag, Aug. 31, Oct. 2013, 18 pages (9 pages for the original document and 9 pages for the English translation).
Venable LLP , “Letter”, dated Jan. 14, 2016, 6 pages.
European Search Report, European Patent Application No. 16153027.4, dated Jul. 22, 2016, 6 pgs.
European Extended Search Report, European Patent Application No. 19198694.2, dated Dec. 20, 2019, 6 pages.
Office Action, Japanese Patent Application No. 2016-066429, dated Aug. 6, 2019, 10 pages.
Office Action, Chinese Patent Application No. 201610217186.5, dated Feb. 2, 2019, 13 pages.
Office Action, Chinese Patent Application No. 201610217186.5, dated Jul. 29, 2019, 15 pages.
Office Action, German Patent Application No. 102015206486.7, dated Apr. 23, 2019, 12 pages.
U.S. Appl. No. 29/691,166, filed May 14, 2019, Unpublished.
U.S. Appl. No. 29/691,854, filed May 20, 2019, Unpublished.
U.S. Appl. No. 16/465,485, filed May 30, 2019, Unpublished.
U.S. Appl. No. 29/693,455, filed Jun. 3, 2019, Unpublished.
U.S. Appl. No. 29/694,634, filed Jun. 12, 2019, Unpublished.
U.S. Appl. No. 29/697,489, filed Jul. 9, 2019, Unpublished.
U.S. Appl. No. 16/680,852, filed Nov. 12, 2019, Unpublished.
U.S. Appl. No. 29/719,889, filed Jan. 8, 2020, Unpublished.
U.S. Appl. No. 29/706,274, filed Sep. 19, 2019, Unpublished.
U.S. Appl. No. 29/721,029, filed Jan. 17, 2020, Unpublished.
Office Action, Japanese Patent Application No. 2016-066429, dated Sep. 7, 2021, 18 pages.

* cited by examiner

FIG 1a Lateral View
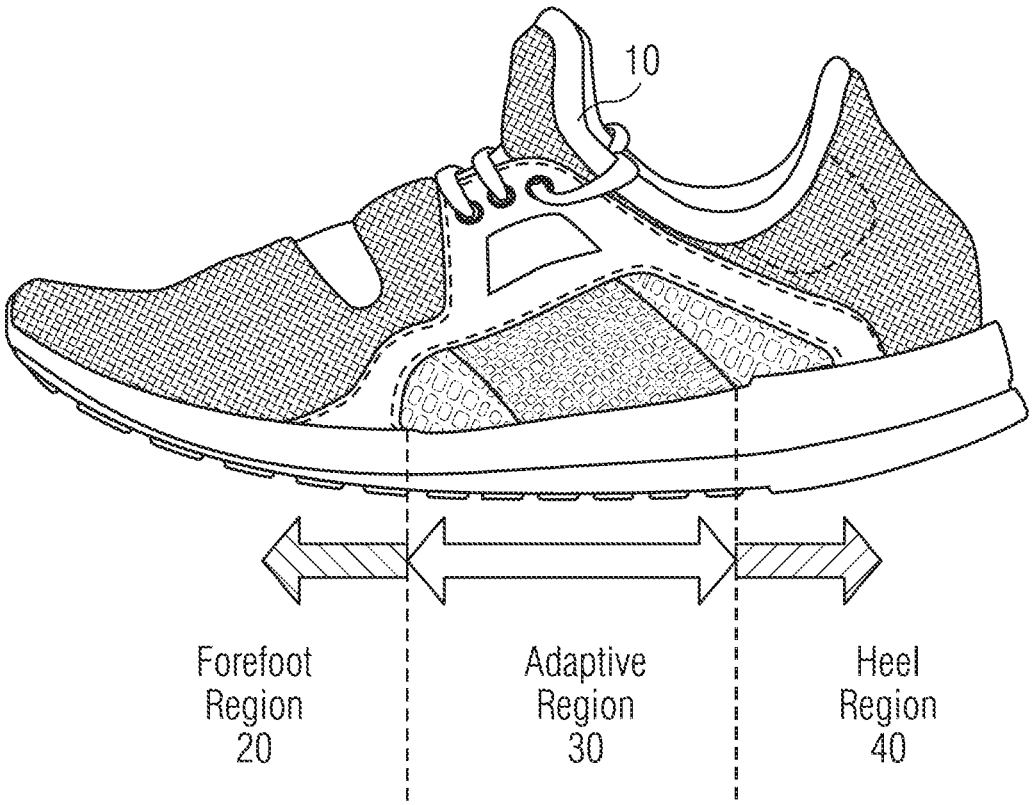

FIG 1b

| | | Total length of shoe 10 [mm] | Length of region | | | Percentage of Length | | |
|---|---|---|---|---|---|---|---|---|
| | | | Heel region 40 [mm] | Adaptive region 30 [mm] | Forefoot region 20 [mm] | Heel region 40 [%] | Adaptive region 30 [%] | Forefoot region 20 [%] |
| Size 5.5 #1 | Medial | 265 | 75 | 75 | 115 | 28% | 28% | 43% |
| | Lateral | | 70 | 80 | 115 | 26% | 30% | 43% |
| Size 5.5 #2 | Medial | 260 | 70 | 80 | 110 | 27% | 30% | 42% |
| | Lateral | | 67 | 80 | 113 | 26% | 30% | 43% |
| Size 5.5 #3 | Medial | 265 | 65 | 90 | 110 | 25% | 34% | 42% |
| | Lateral | | 65 | 85 | 115 | 25% | 32% | 43% |

SPORTS SHOE AND METHOD FOR THE MANUFACTURE THEREOF

CROSS REFERENCE TO RELATED APPLICATION

This application is related to and claims priority benefits from German Patent Application No. DE 10 2015 206 486.7, filed on Apr. 10, 2015, entitled Shoe, in particular a sports shoe, and method for the manufacture thereof ("the '486.7 application"). The '486.7 application is hereby incorporated herein in its entirety by this reference.

FIELD OF THE INVENTION

The present invention relates to a shoe, in particular a sports shoe, and a method for the manufacture thereof.

BACKGROUND

Shoes, in particular sports shoes, usually comprise a shoe sole and a shoe upper.

Shoe soles and shoe uppers typically serve multiple purposes in the overall design of a shoe, for example, one such purpose of the sole of the shoe is to protect the foot of the user from ingress of sharp objects into the plantar surface of the user's foot that otherwise may injure the user. Another such purpose of the sole and/or shoe upper is to control ground reaction forces acting on and through the musculoskeletal system of the user. In addition, the shoe upper in particular, must also provide a comfortable and safe environment for the foot of the user for the duration of time the user is using the shoe.

However, the shoe must adapt to varying conditions over the duration of wear and also to the individual characteristics of the users and their musculoskeletal system during movement, for example, during a gait cycle. It is often a disadvantage of commonly available shoes that this adaptation of the shoe is not sufficient for all users.

In this context U.S. Pat. No. 4,546,559 A1 discloses an athletic shoe, especially a running shoe, formed in such a way that a flexible running sole is provided only in the area of its running surface and, thus, largely does not exist in the area of the longitudinal arch of the foot. Additionally, the running sole has a supporting wall in this area that is fitted to the arch of the foot. U.S. Pat. No. 3,586,003 A1 and U.S. Pat. No. 6,925,734 B1 relate to elements which may be placed in shoes for arch support.

U.S. Pat. No. 5,319,866 A1 as well as its UK counterpart GB 2 258 801 A1 and its French counterpart FR 2 683 432 A1 disclose an athletic shoe having a midsole which is substantially devoid of cushioning material in the arch region. In addition, an arch member is located in the arch region to provide support to the foot of a user.

Therefore, a problem exists to provide a shoe with improved adaptation to both the musculoskeletal system of the user and the conditions encountered during use.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe comprises: a. an upper; and b. a sole unit attached to the upper, wherein c. there is a gap between a lower side of the upper and a top side of the sole unit in a midsole region.

In some embodiments, the gap extends from a lateral side of the shoe to a medial side of the shoe.

In certain embodiments, the upper is attached to the sole unit in a heel region and a forefoot region; and the heel region is a minimum of 15% of a longitudinal shoe length from the rear of the shoe and the forefoot region is a minimum of 20% of the longitudinal shoe length from the front of the shoe.

In some embodiments, the upper comprises a different material in a midfoot region than in a heel region; and the different material in the midfoot region is disposed at least on the lower side of the upper.

In certain embodiments, the upper comprises a different material in a midfoot region than in a forefoot region; and the different material in the midfoot region is disposed at least on the lower side of the upper.

In a midfoot region where the gap is located, in some embodiments, the upper is configured to allow a minimum strain of 5% in both a medial-lateral direction and a forefoot-to-rearfoot direction.

In some embodiments, in a midfoot region where the gap is located, the upper is configured to allow a maximum strain of 150% in both a medial-lateral direction and a forefoot-to-rearfoot direction.

In certain embodiments, the lower side of the upper in a midfoot region is seamless.

In some embodiments, when worn, the upper conforms to at least a portion of an arch of a foot of a user.

The upper, in some embodiments, comprises at least one reinforcing element extending from a medial side of an instep around the lower side of the upper to a lateral side of the instep.

In some embodiments, the at least one reinforcing element connects to or is integrated with a lacing system of the shoe on the medial and the lateral side of the instep.

In certain embodiments, the upper further comprises a lacing element extending from a heel region to a lateral side of an instep and connecting to a lacing system of the shoe.

The lacing element, in some embodiments, is integrally provided as one piece and extends from the medial side of the instep around a heel to the lateral side of the instep.

In some embodiments, the upper further comprises a lacing element extending from a heel region to a medial side of an instep and connecting to a lacing system of the shoe. In certain embodiments, the lacing element is integrally provided as one piece and extends from the medial side of the instep around a heel to the lateral side of the instep.

In certain embodiments, the shoe comprises an insole which is not connected to the upper in a midfoot region. The insole, in some embodiments, is connected to the upper in a heel region and in a forefoot region.

In some embodiments, the sole unit comprises a support element configured to enhance the ability to limit overpronation and/or underpronation.

According to certain embodiments of the present invention, a method of manufacturing a shoe comprises: a. mounting an upper on a last; and b. connecting the upper to a sole unit only in a forefoot region and a heel region, such that in a midfoot region there is a gap between a lower side of the upper and a top side of the sole unit.

In some embodiments, in the midfoot region, the last comprises a concave shape; and when connecting the upper to the sole unit, the upper abuts the last in the midfoot region.

In certain embodiments, when worn, the last comprises a smaller cross-sectional area than a foot of a user with respect to a cross-sectional plane arranged in the midfoot region where the gap is located and with a longitudinal direction of the shoe is approximately perpendicular to the cross-sectional plane.

According to certain embodiments of the present invention, a shoe comprises: an upper; a sole unit comprising a midsole and an outsole; and a lacing element, wherein: the upper is attached to the sole unit such that in a midfoot region there is a gap between a lower side of the upper and a top side of the sole unit; and the midfoot region of the upper comprises at least one material that is different compared to a heel region and a forefoot region of the upper.

BRIEF DESCRIPTION OF THE DRAWINGS

In the following detailed description, embodiments of the invention are described referring to the following figures:

FIG. 1*a* is a side view of a shoe, according to certain embodiments of the present invention.

FIG. 1*b* is a table of exemplary dimensions of different regions of the shoe of FIG. 1*a*.

BRIEF DESCRIPTION

The present invention seeks to provide an improved shoe, in particular and improved sports shoe, for example, a running shoe.

The problem outlined above is at least partially solved by a shoe, according to claim 1. In embodiments, the shoe comprises an upper and a sole unit, wherein the upper is attached to the sole unit such that in a midfoot region there is a gap between a lower side of the upper and a top side of the sole unit. This region is also termed the "adaptive region".

FIG. 1*a* illustrates the different regions of a shoe, including a heel region, the adaptive region in which the gap is located, and a forefoot region. The upper may be attached to the sole unit in the heel region and the forefoot region.

As a result of the gap between the lower side of the upper and the top side of the sole unit in the midfoot region, in certain embodiments, the upper moves, essentially independently, of the sole unit in the midfoot region. Consequently, the upper may better adapt to the individual characteristics of the musculoskeletal system of the user and/or to the movements and forces the musculoskeletal system is subject to during movement of the user, for example, during a gait cycle. The independent movement of the upper may allow the upper to remain in close proximity to the foot of the user whilst the user is moving. This close proximity of the upper to the foot of the user may support or stimulate the musculoskeletal system so that the system is better equipped to handle the forces acting, for example, through stimulating the arch of the foot to engage the onward postural chain to avoid possible negative effects, for example, arch collapse, thus, increasing the stability of the foot and musculoskeletal system of the user. Furthermore, the gap may prevent or limit rubbing and chafing of the foot. The gap may also increase ventilation to the sole of the foot, consequently enabling a more comfortable environment for the foot of the user.

There may be a connection between the upper and the sole unit in the adaptive region, namely in the region of the gap, the connection being provided in such a manner that the independence of movement of the shoe upper in the adaptive region is not significantly impeded. For example, the adaptive region may be covered on the sides of the shoe by a shoe panel, for example, comprised of mesh or foil. This may help to prevent the ingress of foreign matter, for example, stones or dirt into the gap. The ingress of foreign matter may be undesirable for a number of reasons, for example, a stone could protrude into the lower surface of the upper and press into the plantar region of the foot causing discomfort to the user. Alternatively the ingress of matter may ruin the visual appearance of the shoe in this region.

The gap in the adaptive region may extend from a lateral side of the shoe to a medial side of the shoe.

This may help to decouple the movements of the upper over the entire width of the shoe.

Figure 2:
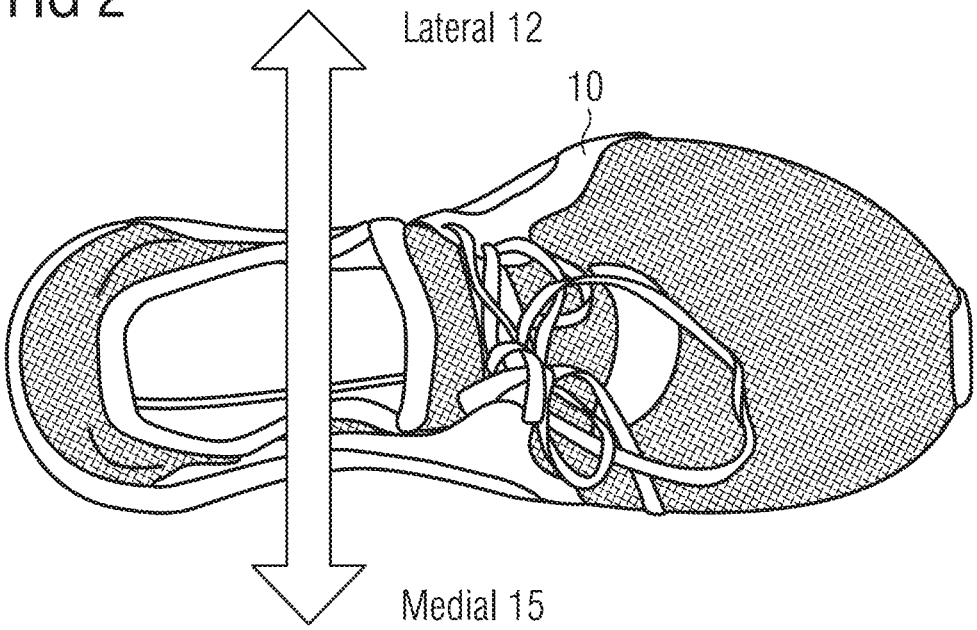
FIG. 2 is a top view of the shoe of FIG. 1*a*.

The medial-lateral direction is shown in FIG. 2 and is to be taken to be the direction in the arch area of the shoe to support and adapt to a foot shape.

The adaptive region consists of a region approximately over the midfoot of the user. As already mentioned, the upper may be attached to the sole unit in the heel region and the forefoot region. The heel region may be a minimum of 15% of the longitudinal shoe length from the rear of the shoe. The heel region may also be a minimum of 25% of the longitudinal shoe length from the rear of the shoe. The forefoot region may be a minimum of 20% of the longitudinal shoe length from the front of the shoe. The forefoot region may also be a minimum of 40% of the longitudinal shoe length from the front of the shoe.

The gap may have a longitudinal extension of at least 2 cm, at least 5 cm, at least 10 cm, at least 15 cm, at least 20 cm of a UK size 8.5 sample size shoe. For a UK size 8.5 sample size shoe, the gap may be in the range of 2 cm to 10 cm.

It will be apparent to the skilled person that the desired gap extension will vary dependent upon the shoe size chosen for the user, for example, a UK size 12 is approximately 32 cm in total length whereas a UK size 6 is approximately 23 cm in length. Clearly the skilled person will realise that the desired gap extension chosen will need to be scaled up or down dependent upon the size of the shoe.

A gap with such a longitudinal extension provides a good compromise between independence of the movement of the upper on the one hand, and ensuring sufficient stability of the shoe upper on the sole unit on the other hand.

The gap may extend essentially over the length of the arch of a foot of a user.

The plantar region of the foot, and in particular the arch of a foot, is subject to significant movement and forces during user movement, for example, during a gait cycle. A gap extending essentially along the length of the user's arch may promote stability of the musculoskeletal system and/or enhance the ability of the musculoskeletal system to react to the forces incurred. The arch of a foot is also a sensitive part of the foot, thus, the upper to extend essentially over the length of the arch of the foot is desirable for the comfort of the shoe for the user.

In certain embodiments, in the midfoot region the lower side of the upper has a shape configured to adapt to a lower side of the arch of the foot of the user.

As a result, the fit of the upper may be improved, thus, further increasing the aforementioned stabilization and engagement effect. Through three-dimensionally pre-shaping the upper such that the shape of the upper is configured to adapt to the lower side of the arch of the foot, the arch may be particularly well ventilated, thus enhancing the comfort of the user in this region of the foot.

In the midfoot region where the gap is located, i.e. in the adaptive region, the upper may be configured to allow a minimum strain of 5% in both the medial-lateral direction and the forefoot-to-rearfoot direction (longitudinally along the shoe). As already stated above, the medial-lateral direction is illustrated in FIG. 2 and is to be taken to be the direction in the arch area of the shoe to support and adapt to a foot shape. In the midfoot region where the gap is located, i.e. in the adaptive region, the upper may be configured to allow a maximum strain of 150% in both the medial-lateral direction and the forefoot-to-rearfoot direction (longitudinally along the shoe). The forefoot-to-rearfoot direction may also be called the anterior-to-posterior direction. The strain may in part be comprised of a strain imparted to the upper during manufacture of the upper. The strain may in part be imparted when the user inserts their foot into the upper. The strain may be imparted during use of the shoe by the user. Sufficient flexibility of the upper may allow the upper to closely abut the foot of a user and hence adapt to the movement and contours of the foot.

The material of the upper may comprise an elastic content. The material of the upper may comprise or be comprised of any material that may perform the stated performance criteria, examples of such materials are: any knitted material, a natural material, a synthetic material, synthetic fibres, synthetic leather, thermoplastic polyurethane (TPU), leather, cotton. Further, the material of the upper may comprise elastane fibres, for example, Lycra which is manufactured under trademark by Invista under license from Koch, formerly part of DuPont.

By using elastane fibres, and in some embodiments Lycra fibres, the upper provided may be flexible but also tear-resistant.

The upper may comprise a different material in the midfoot region than in the heel region and/or in the forefoot region, wherein the different material may be restricted to the lower side of the upper above the gap.

As a result, the material in the midfoot region may be specifically manufactured to provide certain stretch and/or support characteristics for the adaptive region. Using a different material may also allow for tailoring of the remaining regions of the upper to other desired characteristics of these regions.

The upper may be a knitted upper. The knitted upper may be a circular knitted upper. The knitted upper may be a flat knit upper. The knitted upper may be a warp knit. The upper may be an engineered mesh. The upper may also be only partially comprised of at least one of these kinds of materials.

The lower side of the upper, in particular, in the midfoot region, may be seamless.

This may facilitate comfort for the user of the shoe since the region of the arch of the foot is free from areas that may promote rubbing, chafing or pressure points in these sensitive regions of the foot. Furthermore, the lack of any seam in these regions may increase the stability, tear-resistance and fit of the upper.

In certain embodiments, the entire upper may be seamless. The seamless upper may, for example, be provided by circular knitting.

A circular knit upper may allow a three-dimensionally preshaped upper to be provided without an upper blank having to be sewn up at a designated place(s). Thus, unwanted seams in the upper may be avoided and the three-dimensionally preshaped upper may have a particularly good fit and the additional aforementioned benefits of a seamless midfoot region.

The upper may encompass and/or conform to the arch of the foot of the user. Furthermore, particularly in the region of the gap, the upper may abut the foot of the user on all sides of the foot. This may be achieved by using a lacing system.

A lacing system may be used to tie in or secure the foot of a user within the shoe upper. The lacing system can, for example, comprise a shoe lace, or it may comprise a shoe lace and a cord lock, or it may comprise a hook and loop fastener or any other appropriate system for securing the foot of a user.

As a result of the arch of the foot being encompassed by the upper, the beneficial effects indicated above may be further improved. In particular, a particularly comfortable feel and good stabilization and engagement of the foot and onward musculoskeletal system may be achieved.

The upper may have at least one reinforcing element extending from a medial side of the instep around the lower side of the upper to the lateral side of the foot. The reinforcing element can, for example, be arranged on the outside of the upper, or on the inside of the upper, or be integrated within the upper.

The reinforcing element may serve the purpose of increasing the stabilisation and engagement of the foot in the upper, assisting in stabilising the musculoskeletal system of the user. The reinforcing element may be additional to the stability and reinforcement of the upper in the adaptive region. The reinforcing element may be used in conjunction with the upper to provide the desired performance in the adaptive region.

The reinforcing element may connect to or be integrated with a lacing system of the shoe on the medial and the lateral side of the instep. The reinforcing element may also be separate from the lacing system.

The reinforcing element may comprise a flexible yet highly tear resistant material. The material may be a textile material. The material may be a synthetic material. The material may be a synthetic hybrid material. Examples of potential materials are: polyurethane (PU), thermoplastic polyurethane (TPU), compact materials for example, polyamide (PA), polyethylene (PE), polypropylene (PP). The reinforcing element may comprise a webbing. The reinforcing element may comprise a stretchable webbing. The reinforcing element may comprise a non-stretch webbing. The reinforcing element may comprise a mesh. It will be apparent to the skilled person that other similar materials may be used that may perform the basic functionality described herein. The reinforcing element may entirely or only partially be comprised of at least one of these kinds of materials.

A flexible and tear resistant material is particularly suitable for such a reinforcing element, as it will enable a balance between free movement of the upper to allow the aforementioned benefits but also control the stretchability and upper movement which may allow improvements in the aforementioned comfort and stability benefits and/or a tailoring of the resultant properties of the adaptive region for different designs/uses of a shoe incorporating it.

The reinforcing element may be attached to the fabric of the upper, for example, by printing, welding or sewing.

By attaching the reinforcing element to the outer side of the fabric, seams or other unwanted connecting regions that could rub on the foot of the user and thus make the shoe less comfortable to wear may be avoided. Also, a potential tearing of the reinforcing element and the upper in such connecting regions under high load may be avoided. Attaching the reinforcing element to the upper also enables manufacturing processes to be more efficient. For example, in certain embodiments, a process may be streamlined to use the same uppers but apply different reinforcing materials to create shoes with varying degrees of reinforcement.

The reinforcing element may be incorporated into the material of the upper in the midfoot region by increasing the strength and density of the upper material in this region. The reinforcing element may have greater reinforcing properties on the medial side compared with the lateral side.

The benefits of incorporating the reinforcing element are as those stated earlier and additionally that the process of manufacture is simplified, thus, reducing complexity and cost.

In certain embodiments, the upper includes a lacing element extending from a heel region to the lateral side and/or medial side of the instep and connecting to the lacing system of the shoe. The lacing element may not be connected to the sole unit in the midfoot region.

With such a lacing element, the heel region of a foot of a user may be firmly secured to the upper and the strength and stability of the upper in the heel region may be increased, which may be desirable to prevent injuries caused by twisting one's ankle. The lacing element may be formed from a tear-resistant material, for example leather, and it may cooperate with the lacing system to allow for tight lacing of the upper. Not connecting the lacing element to the sole unit may be advantageous as there is no restricting connection between the upper and the sole in the region of the midfoot, thus, this will not interfere with the independent movement of the upper.

The lacing element may be integrally provided as one piece and extend from the medial side of the instep around the heel to the lateral side of the instep.

With a lacing element that is integrally provided as one piece, the overall stability of the upper may be further improved and it may also simplify the manufacture of the shoe since less individual parts need to be processed.

In certain embodiments, in the heel region, the upper is three-dimensionally shaped to abut the back of the user's foot in the region of the Achilles' tendon. In combination with the gap in the midfoot region, an upper provided in this manner may beneficially be used to better lock in the foot while still maintaining sufficient adaptivity of the upper. Also, the fit of the upper in the heel region may be generally improved. In particular rubbing of the upper at the Achilles' tendon may be prevented. Such rubbing may lead to extremely unpleasant irritations, particularly during dynamic movements such as occur when walking or running.

The shoe may comprise an insole, which is not connected to the upper in the midfoot region.

With such an insole, which is not connected to the upper in the midfoot region, the shoe may again be made more comfortable to wear. It may allow the insole to abut the bottom of the foot of a user during the entire gait cycle, thus providing for a consistently pleasant wearing sensation.

The insole may be connected to the upper in the heel region and the forefoot region of the shoe but free in the midfoot region of the shoe. The insole may comprise a "bone-like" shape akin to the surface impression a footprint leaves on the ground.

Such an insole may provide a design that is adjusted to the anatomy of the foot. Consequently, the stress on the foot may be reduced to prevent injuries and to facilitate endurance.

The sole unit may comprise particle(s) of expanded material, in particular, expanded thermoplastic polyurethane (eTPU), and/or expanded polyetherblockamide (ePEBA), and/or expanded polyamide (ePA). The particles may be randomly arranged. The particles may also be connected to each other, for example, at their surfaces. The particles may be connected to each other by providing heat energy provided by pressurized steam, for example, during steam chest molding, or electromagnetic radiation, or radio frequency radiation, or microwave radiation, or infrared radiation, or ultraviolet radiation, or electromagnetic induction. The particles may be connected to each other by providing heat energy provided by a combination of the methods of providing heat energy. The particles may be connected to each other by steam molding. The particles may be connected to each other by use of a binding agent. Alternatively or additionally, the particles may be connected to each other by using a combination of the aforementioned methods. It is to be understood that expanded particles are to be interpreted in the context of the field of particle foams, namely, that the particle has already been expanded or "foamed" prior to being placed within the mold. Therefore, the resulting particle foam component is comprised of a plurality of individual particle foam beads, each bead having already been foamed (to a level that establishes the properties of the foam) prior to be formed into the final component. For example, expanded TPU beads are placed in the mold and then a chemical reaction occurs to form the resulting particle foam components. It should be noted that there are a number of synonymous terms used within the art that describe the same concept, for example, "foamed bead(s)", "foamed pellet(s)", "particle foams" to name just some.

A sole unit comprising expanded particles, i.e. particle foam, may provide good cushioning properties over a wide temperature range. At the same time, sole units with such particles may return a large share of the energy exerted to deform the sole during impact back to the foot when the sole expands again later in the gait cycle. This may facilitate efficiency in walking or running and thus increase the endurance of the user. The particles may be randomly arranged which might facilitate ease of manufacture. Alternatively, a conventional ethylene-vinyl-acetate (EVA) or any other shoe sole could be used, and also sole units with combinations of particles from expanded materials and other materials, for example, EVA, eTPU, ePEBA and/or ePA are possible.

The sole unit may comprise a support element, in particular to enhance the ability to limit overpronation and/or underpronation. The support element may be arranged in the midfoot region.

With such an additional support element, the stress on the foot may be further relieved. This may further help in stabilising the foot and musculoskeletal system of the user and aid in preventing injuries or fatigue.

The support element may also serve to adjust the bending stiffness and/or torsional stiffness of the sole unit in the midfoot region. The support element can, for example, be embedded in the material of the sole unit.

A further aspect of the invention is given by a method for the manufacture of a shoe, in particular a sports shoe like a running shoe, comprising the following steps: Mounting an upper on a last and connecting the upper to a sole unit only in a forefoot region and a heel region, such that in a midfoot region there is a gap between a lower side of the upper and a top side of the sole unit.

In some embodiments of such an inventive method, it is possible to combine the optional design possibilities for an inventive shoe discussed above in various combinations and thus adjust the properties of the manufactured shoe to the respective requirements during manufacture.

The last may comprise a concave shape in the midfoot region, wherein, during the step of connecting, the upper abuts the last in the midfoot region. The concave shape may be in correspondence with the arch of a foot of a user.

As a result of the upper being mounted during the method on a last, whose shape may be in correspondence with the arch of the foot, undesired distortions or deformations of the upper may be prevented. The upper may be mounted on the last "under tension" so that it abuts the last in a form-fit manner.

The shape, dimensions and configuration of the concave region of the last may be adjusted to control and influence the degree of tension imparted to the resultant upper in the midfoot region.

The last may comprise a smaller cross-sectional area than the foot of a user with respect to a sectional plane arranged in the midfoot region where the gap is located and with the longitudinal direction of the shoe being approximately perpendicular to the sectional plane. The cross-sectional area of the last may for example be less than 80% of the corresponding cross-sectional area of the average foot (for example measured when the foot is inserted into the finished shoe), or less than 70% or less than 60%, or less than 50%.

In certain embodiments, the sole unit includes particles of an expanded material, in particular of expanded thermoplastic polyurethane (eTPU), and/or of expanded polyether-blockamide (ePEBA), and/or of expanded polyamide (ePA). The particles may be randomly arranged. The particles may also be connected to each other.

The beneficial properties of these materials for use in a sole unit have already been described above.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Possible embodiments of the present invention are described in the following detailed description mainly in relation to running shoes. However, emphasis is placed on the fact that the present invention is not limited to these embodiments. Instead, it may also be applied to other types of shoes, such as sports shoes in general, leisure shoes, etc.

It is also to be noted that only individual embodiments of the invention are described in greater detail below. However, it is clear to the person skilled in the art that the design possibilities described in relation to these specific embodiments may also be further modified and combined in a different manner with one another within the scope of the present invention and that individual features may also be omitted where they appear to be unnecessary. In order to avoid repetition, reference is made to the explanations in the previous sections, which also remain applicable to the following detailed description.

Figure 3A:
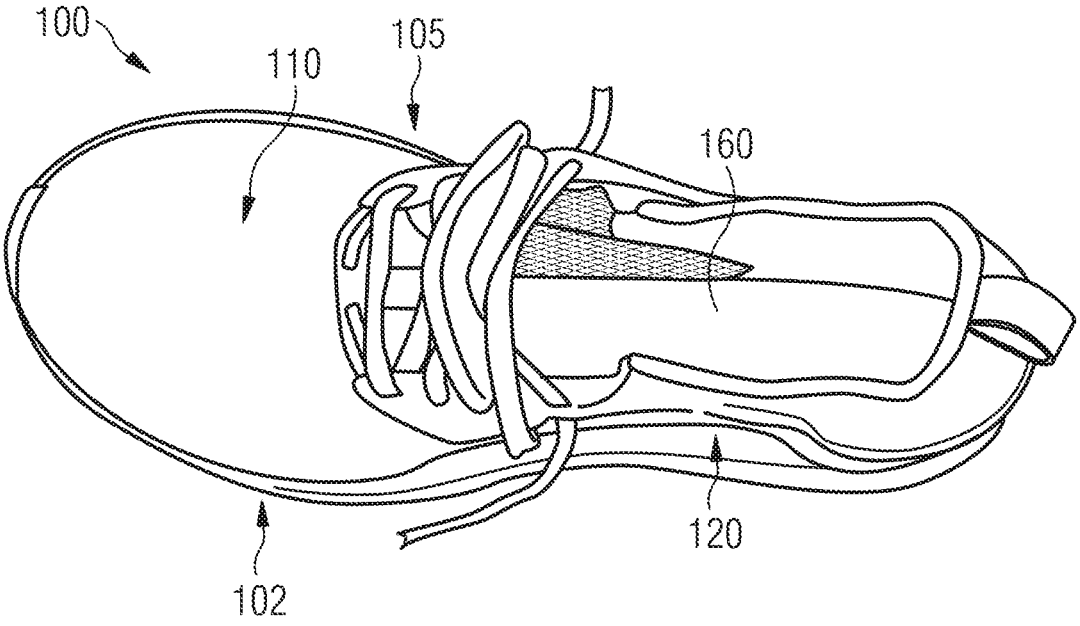
FIG. 3*a* is a top view of a shoe, according to certain embodiments of the present invention.
Figure 3B:
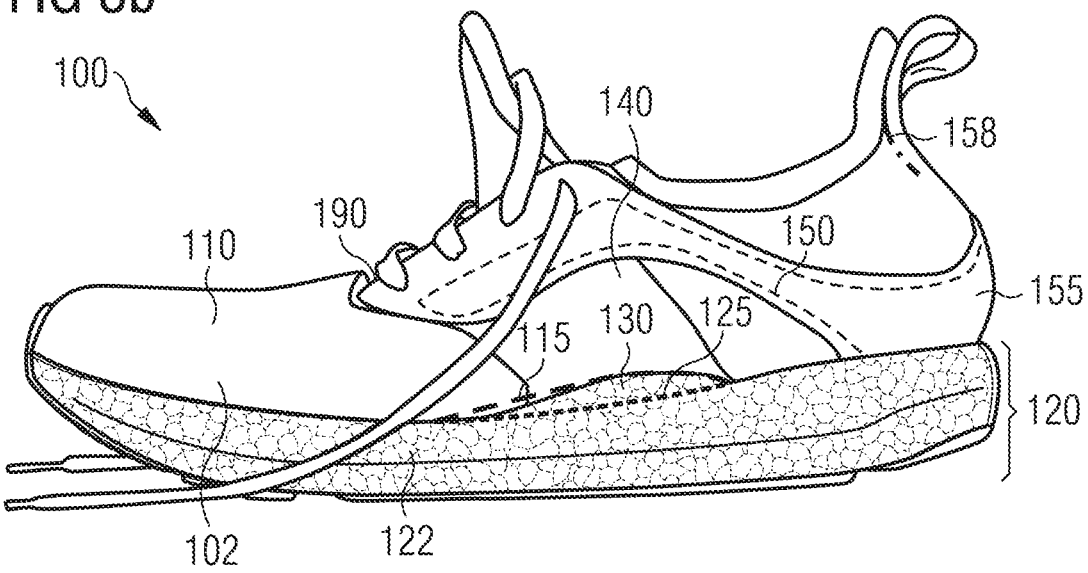
FIG. 3*b* is a lateral side view of the shoe of FIG. 3*a*.
Figure 3C:
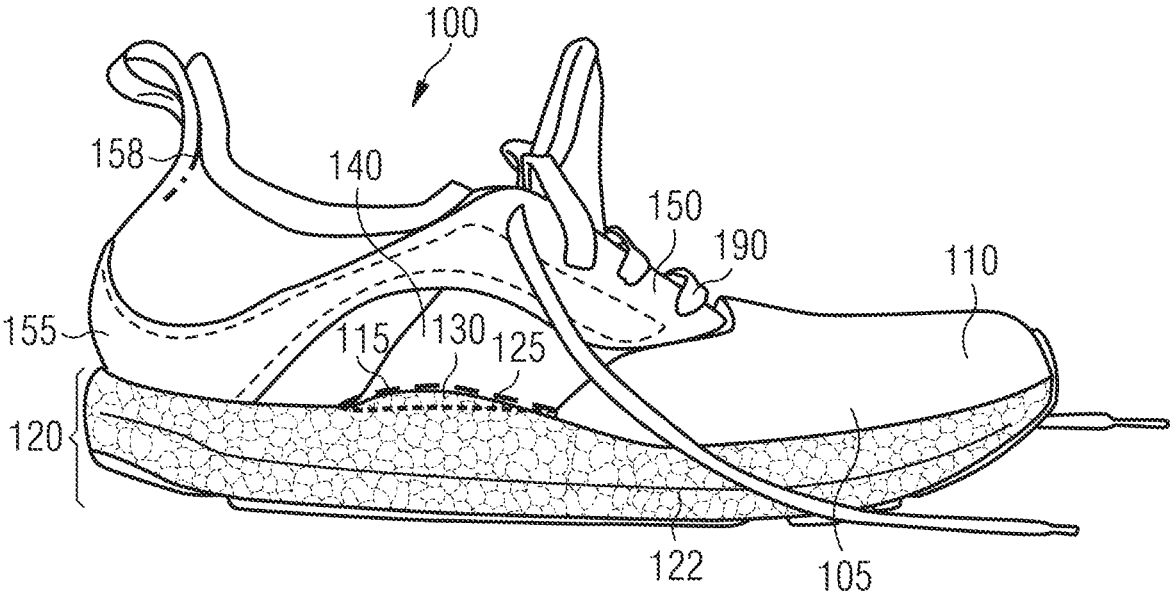
FIG. 3*c* is a medial side view of the shoe of FIG. 3*a*.
Figure 3D:
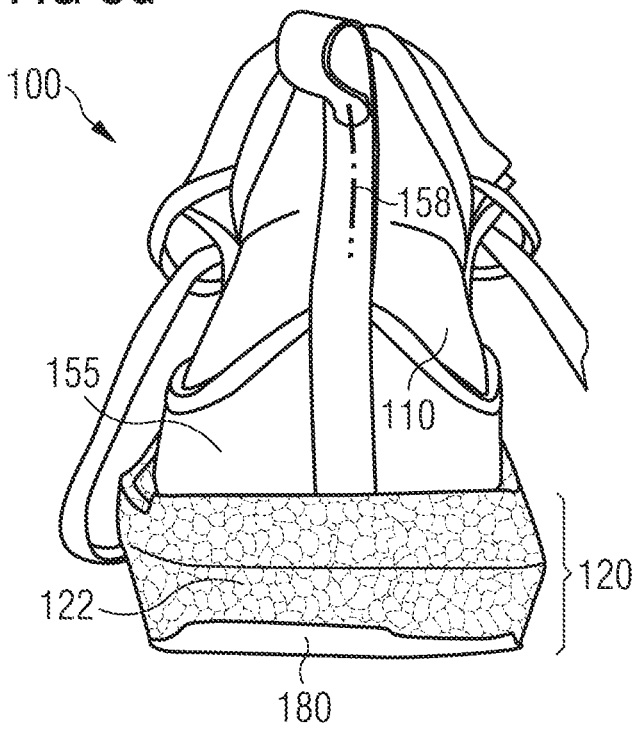
FIG. 3*d* is a rear view of the shoe of FIG. 3*a*.
Figure 3E:
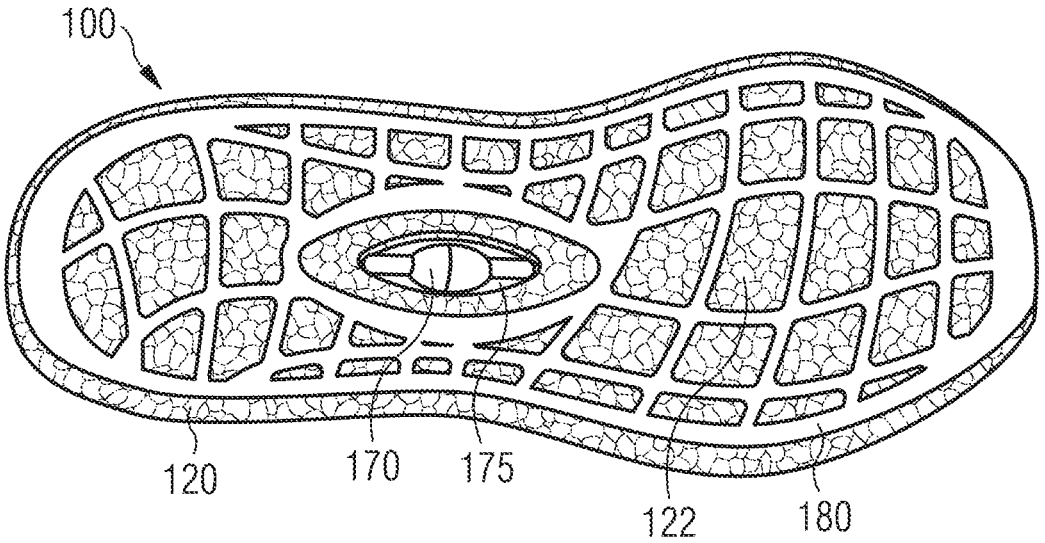
FIG. 3*e* is a bottom view of the shoe of FIG. 3*a*.
Figure 3F:
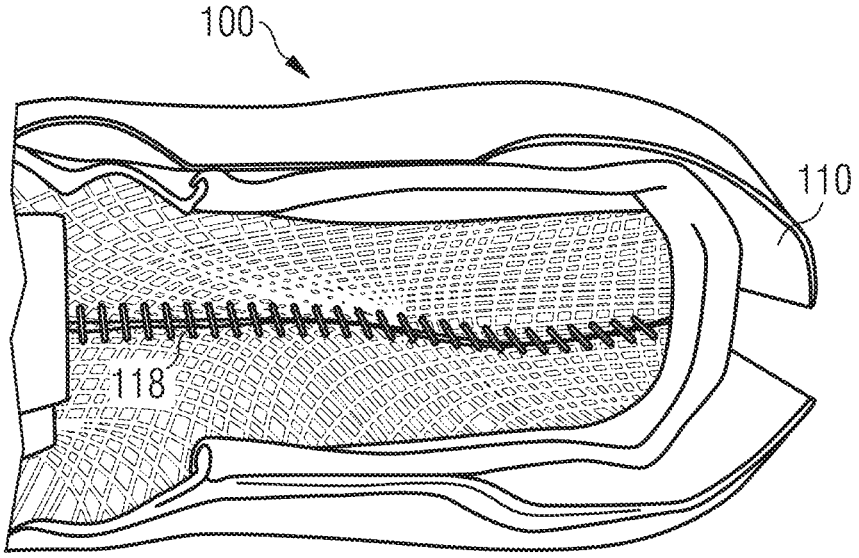
FIG. 3*f* is a partial internal view of the shoe of FIG. 3*a*.

FIGS. 3*a-f* show embodiments of a shoe 100 according to the invention. FIG. 3*a* shows the shoe 100 in a top view. FIG. 3*b* shows a lateral side view and FIG. 3*c* shows a medial side view of the shoe 100. FIG. 3*d* shows the shoe 100 from the back and FIG. 3*e* shows a bottom view of the shoe 100. FIG. 3*f* shows an enlarged picture of the inside of the upper 110 of the shoe 100 with the insole removed.

The shoe 100, which may be used as a running shoe, comprises an upper 110 and a sole unit 120. Here, the upper 110 is attached to the sole unit 120 such that in a midfoot region of the shoe 100 there is a gap 130 between a lower side 115 of the upper 110 and a top side 125 of the sole unit 120.

In the shoe 100, the gap 130 extends from a lateral side 102 of the shoe 100 to a medial side 105 of the shoe 100. This means that the gap 130 extends over the entire width of the shoe 100. This may be seen in FIG. 3*b* showing the lateral side 102 of the shoe 100 and FIG. 3*c* showing the medial side 105 of the shoe 100. Here it may be seen that the gap 130 between the lower side 115 of the upper 110 and the top side 125 of the sole unit 120 in the midfoot region extends from the lateral side 102 to the medial side 105 of the sole unit 120. In the shoe 100, there is no connection between the upper 110 and the sole unit 120 in the region of the gap 130.

In the embodiments shown in FIGS. 3*a-f*, the gap 130 comprises a longitudinal extension, i.e. an extension in the direction from the heel to the tips of the toes of the foot.

By way of example, FIG. 1*a* shows embodiments of an inventive shoe 10. The longitudinal extension of the gap in the shoe 10 shown in FIG. 1*a* and other embodiments is dependent on the desired degree of decoupling of the upper from the sole unit. The desired degree of decoupling of the upper from the sole unit may be based upon at least one of a range of factors, for example: the desired tension in the midfoot region, the desired extension of the gap in relation to the upper, or the average size of a user's foot or a user's arch length or any combination thereof. Furthermore, the longitudinal extension of the gap will also be dependent on the selected shoe size.

FIG. 1*a* also illustrates the different regions of an inventive shoe 10, namely a forefoot region 20, the midfoot region where the gap between the upper and the sole unit is located and which is also called the adaptive region 30, and a heel region 40. The upper may be attached to the sole unit in the heel region 40 and in the forefoot region 20. As shown, the sole unit comprises an outsole expanding from a forefoot region to a heel region and that is attached to the lower textile surface of the upper around at least the outer edges of the sole in the forefoot region and the heel region except in a detached region in a midfoot region. The forefoot region extends from the midfoot region to a frontmost edge and from a lateral edge to a medial edge of the sole unit. The heel region extends from the midfoot region to a rearmost edge and from the lateral edge to the medial edge of the sole unit. The lower textile surface of the upper is directly attached to the sole unit in the forefoot region and the heel region of the shoe to form two directly attached regions. The lower surface of the upper is detached from the sole unit in a midfoot region between the two directly attached regions to form the detached region, which is adapted to conform to an arch of a foot of a user. The detached regions form a substantially horizontal opening that passes, in a longitudinal direction, below the lower textile surface of the upper and above the sole unit in the midfoot regions. The skilled person will realise that these regions may analogously be defined for other embodiments of an inventive shoe.

Exemplary dimensions for three samples of an inventive shoe 10 of size UK 5.5 are listed in the table of FIG. 1*b*. For example, sample #1 has an overall length of 265 mm. The length of the adaptive region 30 is 75 mm (on the medial side) which is 28% of the overall length of sample #1. The heel region 40 is 75 mm (on the medial side) which is 28% of the overall length of sample #1. The forefoot region 20 is 115 mm (on the medial side) which is 43% of the overall length of sample #1.

Clearly the skilled person will realise that the desired gap adaptive region 30 and therefore gap length will have to be scaled up or down for different size shoes, for example, scaled up for a UK size 16 and scaled down for a UK size 4. The minimum length of the forefoot region 20 is 15% of the overall length of the shoe 10. The minimum length of the heel region 40 is 20% of the overall length of the shoe 10. Depending on the size of the shoe 10, the gap may have a longitudinal extension of up to 20 cm, for example a longitudinal extension in the range from 2 cm-10 cm. The gap may for example extend essentially over the length of the arch of a foot of a user having the respective shoe size. The considerations put forth with regard to FIGS. 1*a-b* may also apply to other embodiments of an inventive shoe, like the embodiments of inventive shoes 100, 300 and 500.

Returning to the discussion of FIGS. 3*a-f*, these figures show that the upper 110 encompasses and/or conforms to the arch of the foot of the user. In other words, the upper extends from the lateral side 102 of the shoe along the gap 130 to the medial side 105 of the shoe 100. In the midfoot region, the lower side 115 of the upper 110 has a shape configured to adapt to the lower side of the arch of the foot of a user. In other embodiments the upper need not fully encompass the arch of a foot. In some embodiments, the upper conforms to a portion of the arch. As the upper 110 comprises a degree of elasticity and is decoupled from the sole unit 120 in the midfoot region, the upper 110 adapts, in terms of its shape, to the individual characteristics of the musculoskeletal system of the user and/or to the movements and forces the musculoskeletal system is subject to and/or the movements a foot of a user undergoes during movement of the user, for example, during a gait cycle.

In the midfoot region where the gap 130 is located, i.e. in the adaptive region, the upper 110 may be configured to allow a minimum strain of 5% in both the medial-lateral direction and forefoot-to-rearfoot direction (also called the anterior-to-posterior direction). The allowed minimum strain may also be 10% or 15% or 20% or 30% or 50%. In the midfoot region where the gap is located, i.e. in the adaptive region, the upper 110 may be configured to allow a maximum strain of 150% in both the medial-lateral direction and forefoot-to-rearfoot direction. The allowed maximum strain may also be 125% or 110% or 100% Or 80%. The medial-lateral direction is illustrated in FIG. 2 for the sample shoe 10 which is also shown in FIG. 1*a*. The medial-lateral direction is to be taken to be the direction from the medial side 15 to the lateral side 12 in the arch area of the shoe 10 to support and adapt to a foot shape. Again, these considerations may also apply to other embodiments of an inventive shoe, like the embodiments of inventive shoes 100, 300 and 500.

The strain may in part be comprised of a strain imparted to the upper 110 during manufacture of the upper 110. The strain may in part be imparted when the user inserts their foot into the upper 110. The strain may be imparted during use of the shoe 100 by the user. The strain may in part be imparted to the adaptive region by a combination of strain imparted in manufacture and during insertion of the foot of a user and during use.

To illustrate with an example, uppers comprising a material that may be stretched in all four directions (front or anterior, rear or posterior, medial, lateral) were tested and allowed a minimum strain of 60% under a load of 100 N/cm in a warp direction of the mesh, and a minimum strain of 130% in a weft direction of the mesh. The weft direction of the mesh is aligned to allow the stretch in the medial and lateral directions. The above mentioned load of 100 N/cm refers to laboratory test method for material testing where a strip of mesh approximately 2.54 cm wide is tested. The strain values stated above are based on an internal laboratory test method which is why the strain values are much higher than the values stated with regard to the upper, as the forces acting during running are lower than the recited test values in the laboratory.

An FEA (Finite Element Analysis) virtual simulation study was conducted that showed that the strain when the material is pulled over the last was on average 50%-60% in the adaptive region with a maximum of 92% at the midfoot seam. Once the last was removed from the upper some of this strain imparted by the last is removed whilst some is retained in the final shoe upper. The amount of strain retained will be dependent on the material used for the upper.

To evaluate the performance of the shoe during use, testing was performed using an Aramis system from GOM mbH. The system is a calibrated digital image correlation (DIC) device which allows for dynamic real time surface strain measurement. The results found that the materials selected for the upper strained 6-14% under the load of the bodyweight of the user. Further strain was seen when the user was running, an average material strain being 20% with a maximum strain of 48% in the medial midfoot region. It will be apparent to the skilled person that the values quoted are testing values for the specific examples. The values will change depending upon the type of movement being performed and also the individual user.

The material of the upper 110 may comprise an elastic content. The material may comprise or be comprised of any material that may perform the stated performance criteria, examples of such materials are: any knitted material, a natural material, a synthetic material, synthetic fibres, synthetic leather, thermoplastic polyurethane (TPU), leather, cotton. Further, the material of the upper 110 may comprise elastane fibres, for example, Lycra which is manufactured under trademark by DuPont.

The upper 110 may be a knitted upper. The knitted upper may be a circular knitted upper. The knitted upper may be a flat knit upper. The knitted upper may be a warp knit. The upper 110 may be an engineered mesh. The upper 110 may also be only partially comprised of at least one of these kinds of materials.

In some embodiments, a shoe 100, as shown in FIGS. 3*a-f*, includes an upper 110 that is manufactured using a blank that may be trimmed and then sewn up (or otherwise attached/connected) in certain places. An example of such a blank is the blank 200 shown in FIG. 4. As a result of the connection process, the upper 110 is provided with a three-dimensional shape. By a suitable design of the blank, in some example, the desired three-dimensional shape of the upper 110, in particular in the region of the arch of the foot, may be achieved.

In the embodiments shown in FIG. 3*f*, the manufacture of the upper 110 has resulted in the lower side 115 of the upper 110 comprising a seam 118 which extends in the longitudinal direction over the lower side 115 and in particular over the region of the arch of the foot.

However, in other embodiments, the lower side of the upper 110 may be without a seam in the midfoot region. As already mentioned, the upper 110 may for example be provided in the midfoot region by circular knitting—or even the entire upper 110 may be provided by circular knitting. Circular knitting may allow providing a three-dimensionally shaped textile component without a seam. Further alternatives to circular knitting could be: 3D formed uppers (e.g. 3D printed uppers), overinjected textiles, molded materials, injected materials or vacuum formed materials.

In the midfoot region, the upper 110 of the shoe 100 may comprise a reinforcing element 140. Any number (e.g. one, two, three, four, five, etc.) of reinforcing elements and/or reinforcing elements with different widths than shown here are also possible. The reinforcing element 140 extends from the medial side 105 of the instep around the lower side 115 of the upper 110 and beneath the arch of the foot to the lateral side 102 of the instep.

The reinforcing element 140 can, for example, comprise thermoplastic polyurethane, which may be welded to the fabric of the upper 110 on the outside of the upper 110 as shown in FIGS. 3*b* and 3*c*.

The reinforcing element may also be arranged on the inside of the upper 110 or be integrated within the upper 110.

Figure 3G:
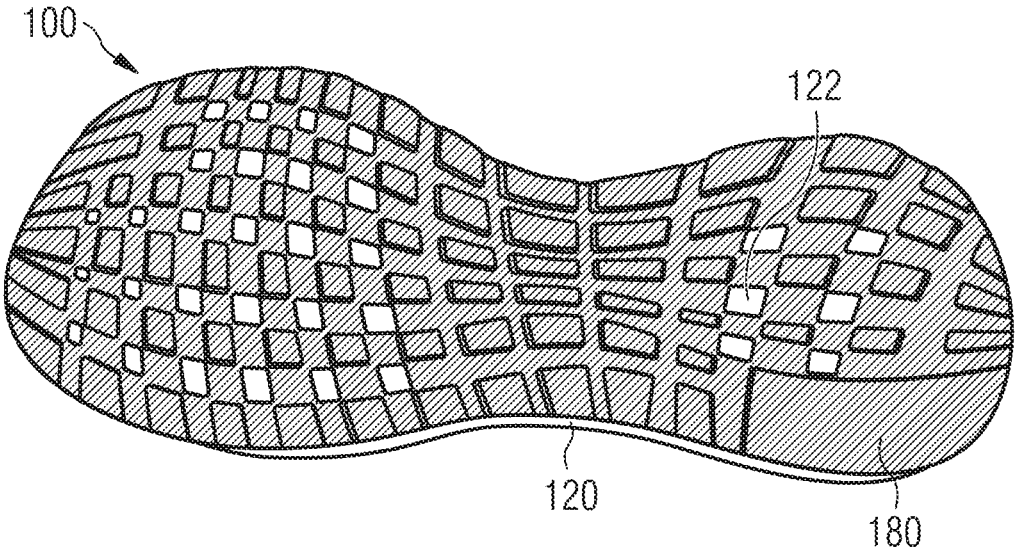
FIG. 3*g* is a bottom view of the shoe of FIG. 3*a*.
Figure 3H:
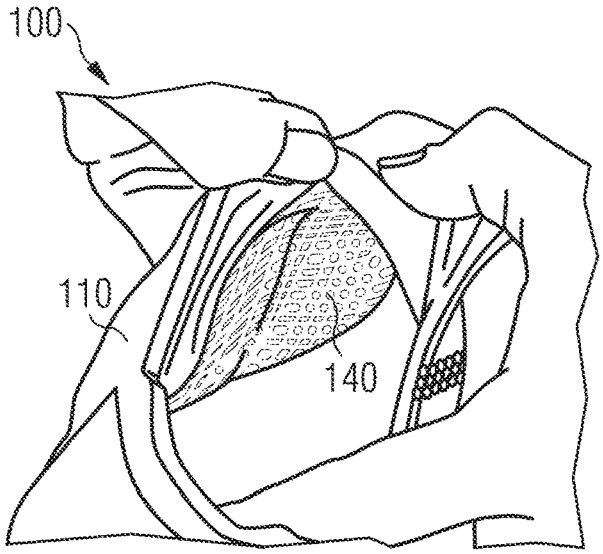
FIG. 3*h* is a partial internal view of the shoe of FIG. 3*a*.

By way of example, FIG. 3*h* shows embodiments of the shoe 100 having an upper 110 with a reinforcing element 140 arranged on the inside of the upper 110. Here, the reinforcing element 140 is provided as a webbing or mesh. Apart from that, the embodiments shown in FIG. 3*h* may be the same or similar to the embodiments shown in FIGS. 3*a-f*.

Moreover, the shoe 100 may also be without a reinforcing element.

The reinforcing element 140 may connect to or be integrated with a lacing system of the shoe 100 on the medial side 105 and the lateral side 102 of the instep. The reinforcing element 140 may also be separate from the lacing system. With the help of the lacing system, the foot of a user may be secured within the upper 110 of the shoe 100.

The reinforcing element 140 may comprise a flexible yet highly tear resistant material. The material may be a textile material. The material may be a synthetic material. The material may be a synthetic hybrid material. Examples of potential materials are: polyurethane (PU), thermoplastic polyurethane (TPU), compact materials for example, polyamide (PA), polyethylene (PE), polypropylene (PP). The reinforcing element 140 may comprise a webbing. The reinforcing element 140 may comprise a stretchable webbing. The reinforcing element 140 may comprise a non-stretch webbing. The reinforcing element 140 may comprise a mesh. It will be apparent to the skilled person that other similar materials may be used that may perform the basic functionality described herein. The reinforcing element 140 may entirely or only partially be comprised of at least one of these kinds of materials.

The reinforcing element 140 may be attached to the fabric of the upper 110, for example, by printing, welding or sewing, and on the inside of the upper 110 as well as on the outside.

In the case of the embodiments of the shoe 100 shown in FIGS. 3*b-c*, the lateral and medial parts of the reinforcing element 140 are sewn together with the seam 118 in the region of the arch of the foot. The reason for this is that for the manufacture of the shoe 100 an initially flat-shaped blank similar to the blank 200 shown in FIG. 4 was trimmed and sewn up, as already mentioned. In this way, the upper 110 was given its three-dimensional shape.

Figure 4:
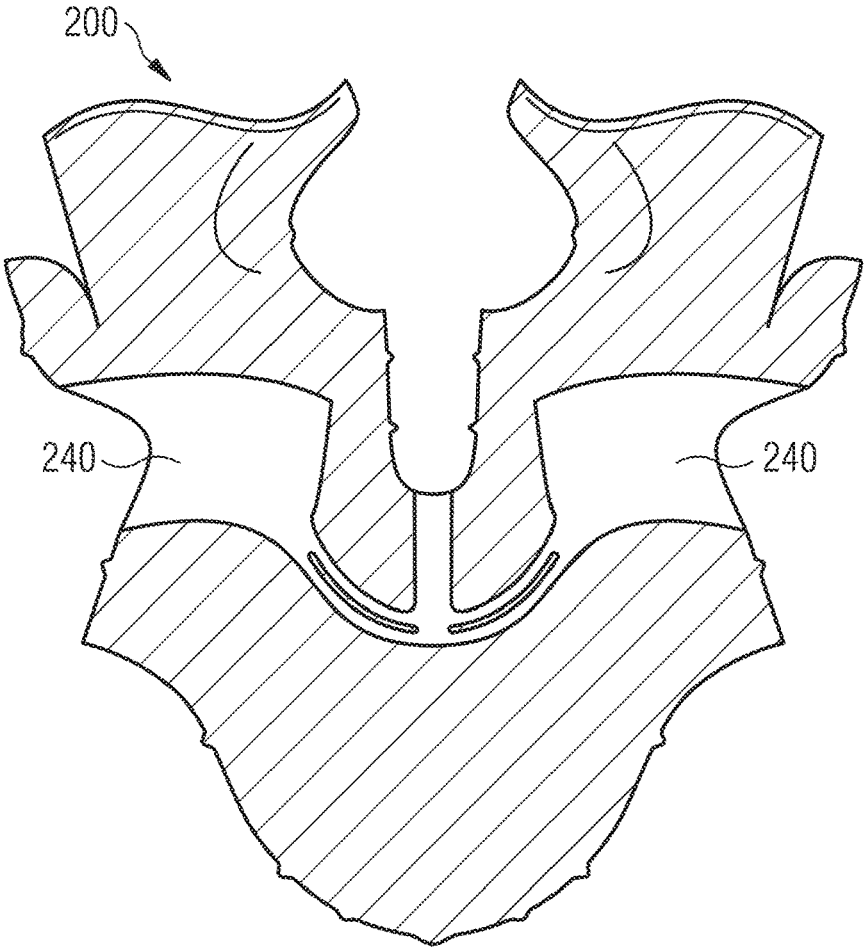
FIG. 4 is a top view of a blank, according to certain embodiments of the present invention.

As can be seen in FIG. 4, in some embodiments, the blank 200 contains a reinforcing element 240, which, in the unconnected state of the blank 200 shown in FIG. 4, comprise a separate lateral and medial partial region. Only once the blank 200 has been connected to produce its three-dimensional shape, for example by a seam along the arch of the foot, a connected reinforcing element corresponding to the reinforcing element 140 is created which extends from the medial side of the instep around the lower side of the upper and beneath the arch of the foot to the lateral side of the instep.

An advantage of this approach is that the reinforcing element 240, which is not yet connected in the unconnected state of the blank 200, may be particularly well printed on, welded or otherwise applied to the blank 200. In the case of an already three-dimensionally preshaped blank, this could be more difficult or involve greater expense.

Returning to the discussion of the embodiments of a shoe 100 shown in FIGS. 3*a-f*, the upper 110 of the shoe 100 further comprises a lacing element 150. The lacing element 150 may be made of leather so that it has a high degree of stability and tear-resistance. The lacing element extends from the heel region of the upper 110 to the lateral side 102 and to the medial side 105 of the instep and it connects to a lacing system of the shoe 100, which, in the case shown here, is provided as a shoe lace 190. The shoe lace 190 is threaded through the openings in the lacing element 150. It is to be noted that the lacing element 150 is not connected to the sole unit 120 in the midfoot region of the shoe 100 in the embodiments shown here, such that the decoupling of the movements of the upper 110 from the sole unit 120 in the midfoot region is not impeded by the lacing element 150.

For the shoe 100, the lacing element 150 is integrally provided as one piece and extends from the medial side 105 of the instep around the heel to the lateral side 102 of the instep. In these regions, the lacing element 150 is sewn up to the reinforcing element 140 to increase the stability of the upper 110. However, it should be understood that other types of attachment for securing or attaching the lacing element 150 may be utilized.

A heel counter 155 for an improved securing of the heel in the upper 110 is also integrated into the lacing element 150. The heel counter may help in preventing the foot from sliding and blisters from forming. In the heel region, the upper 110 is also three-dimensionally shaped to abut the back of the user's foot in the region of the Achilles' tendon. To this end, the upper 110 comprises a heel groove 158 in this region, which abuts the back of the user's foot.

The shoe 100 further comprises an optional insole 160. The insole 160 is not connected to the upper 110 in the midfoot region. Instead, the insole 160 is connected to the upper 110 merely in the heel region and in a forefoot region of the foot. Consequently, the insole 160 may by and large move independently of the upper 110, such that the insole 160 may be in contact with the bottom side of the foot during much of a gait cycle and the shoe 100 is particularly comfortable to wear.

The sole unit 120 shown in FIG. 3*e* includes a support element 170 in the midfoot region, which is a three-dimensionally shaped support element 170. It comprises two partial regions extending from the midfoot region to the heel region and the forefoot region of the midsole 122 and being at least partially embedded in the material of the midsole 122. The two partial regions are connected to each other in a connection region, so that they may be rotated against each other at least up to a certain locking angle. The connection region is arranged in a window 175 in the midsole so as not to impede this rotation. The support element 170 allows the bending stiffness of the sole unit 120 to be influenced and controlled independently of its torsional or twisting stiffness.

The support element 170 may also enhance the ability of the sole unit 120 to limit overpronation and/or underpronation, to support the arch of the foot or to otherwise compensate for malposition or disadvantageous characteristic motion patterns of a user.

The sole unit 120 of the shoe 100 comprises a midsole 122, which comprises particles of an expanded material. The particles may be randomly arranged and they may be connected to each other, for example at their surfaces. For the shoe 100, randomly arranged particles from expanded thermoplastic polyurethane (eTPU) were used, which were welded to each other by providing heat to their surfaces. The heat may, for example, be provided in the form of pressurized steam, for example, during steam chest molding, or electromagnetic radiation, or radio frequency radiation, or microwave radiation, or infrared radiation, or ultraviolet radiation, or electromagnetic induction. The particles may be connected to each other by providing heat energy provided by a combination of the methods of providing heat energy. The use of a binding agent is also possible. In addition, particles from expanded polyetherblockamide (ePEBA) and/or from expanded polyamide (ePA) may also be used.

The sole unit 120 also comprises an outsole 180. In the present case, the outsole 180 is provided in a net- or lattice-form to reduce the weight and still allow good traction of the shoe 100. In certain embodiments, the outsole 180 may include, for example, thermoplastic polyurethane and/or rubber.

In certain embodiments, the sole unit 120 need not necessarily comprise a support element. By way of example, FIG. 3*g* shows embodiments of the shoe 100 with a different sole unit 120 having a midsole 122 and an outsole 180, which does not comprise a support element. Apart from that, the embodiments shown in FIG. 3*g* may be the same or similar to the embodiments shown in FIGS. 3*a-f*.

Figure 5A:
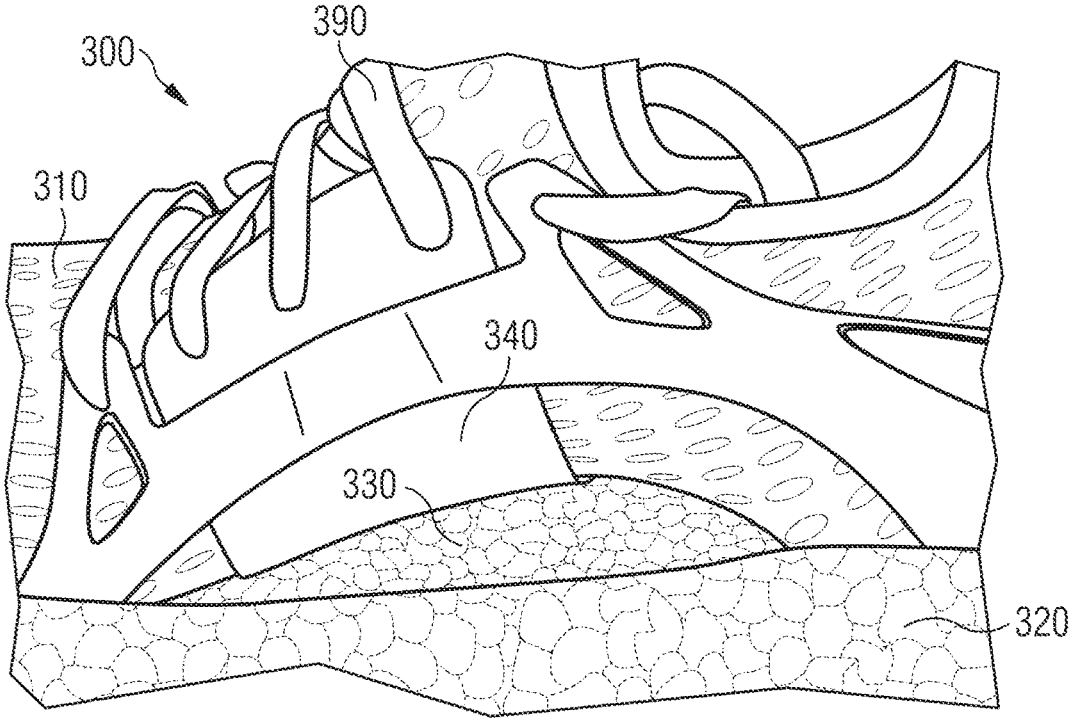
FIG. 5*a* is a detail view of a shoe, according to certain embodiments of the present invention.
Figure 5B:
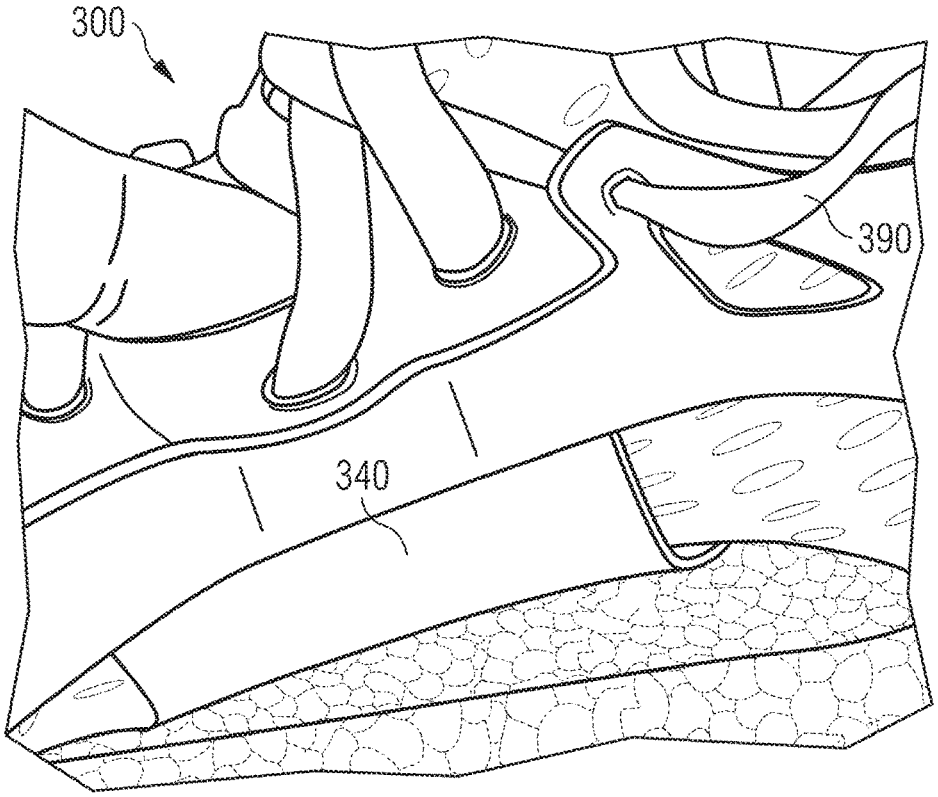
FIG. 5*b* is a detail view of the shoe of FIG. 5*a*.
Figure 5C:
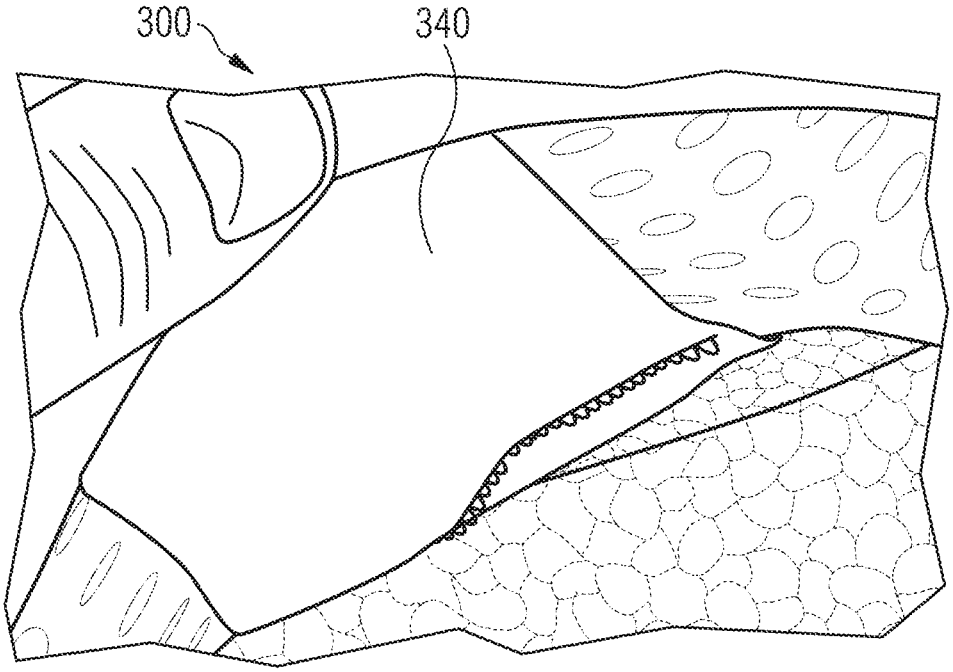
FIG. 5*c* is a detail view of the shoe of FIG. 5*a*.

FIGS. 5*a-c* show a further embodiments of an inventive shoe 300. The statements made with regard to the shoe 100 analogously apply to the embodiments of a shoe 300. Therefore, those features of the shoe 300 which differ from the shoe 100 are predominantly discussed below.

The shoe 300 comprises an upper 310 and a sole unit 320, wherein the upper 310 is attached to the sole unit 320 such that in a midfoot region of the shoe 300 there is a gap 330 between a lower side of the upper 310 and a top side of the sole unit 320.

The shoe 300 comprises a reinforcing element 340 extending from a medial side of the instep around the lower side of the upper 310 and beneath the arch of the foot to a lateral side of the instep. The reinforcing element 340 connect to a lacing system of the shoe 300, here the shoe lace 390, on the medial and the lateral side of the instep. In the embodiments shown in FIGS. 5*a-c*, this connection is provided by the ends of the reinforcing element 340 comprising eyelets (loops or something similar are also conceivable) both on the lateral and the medial side of the instep through which a shoe lace 390 may be threaded. Thus, the reinforcing element 340 may be tightened around the midfoot region of the foot by tying up the shoe lace 390.

Unlike the reinforcing element 140, the reinforcing element 340 is, at least partially, not fixedly connected to the upper 310. Instead, the reinforcing element 340 may in parts move independently of the upper 310. In the embodiments show in FIGS. 5*a-c*, the reinforcing element 340 is not fixedly connected to the upper 310 in the region of the lateral and medial instep. This can be seen in FIG. 5*b*, in which the top of the reinforcing element 340 is pulled away from the upper 310 by hand.

In the embodiments shown in FIGS. 5*a-c*, the reinforcing element 340 is made from leather and comprises a high stretch resistance. Further possible materials have already been named in the context of the discussion of the reinforcing element 140 and these materials may also be used for the reinforcing element 340.

Figure 6A:
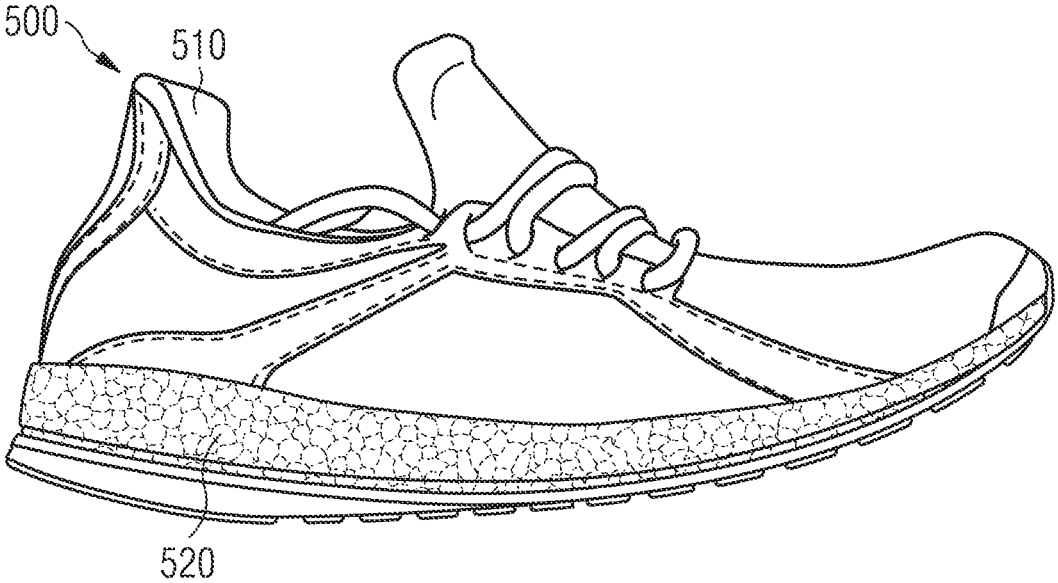
FIG. 6*a* is a side view of a shoe, according to certain embodiments of the present invention.
Figure 6B:
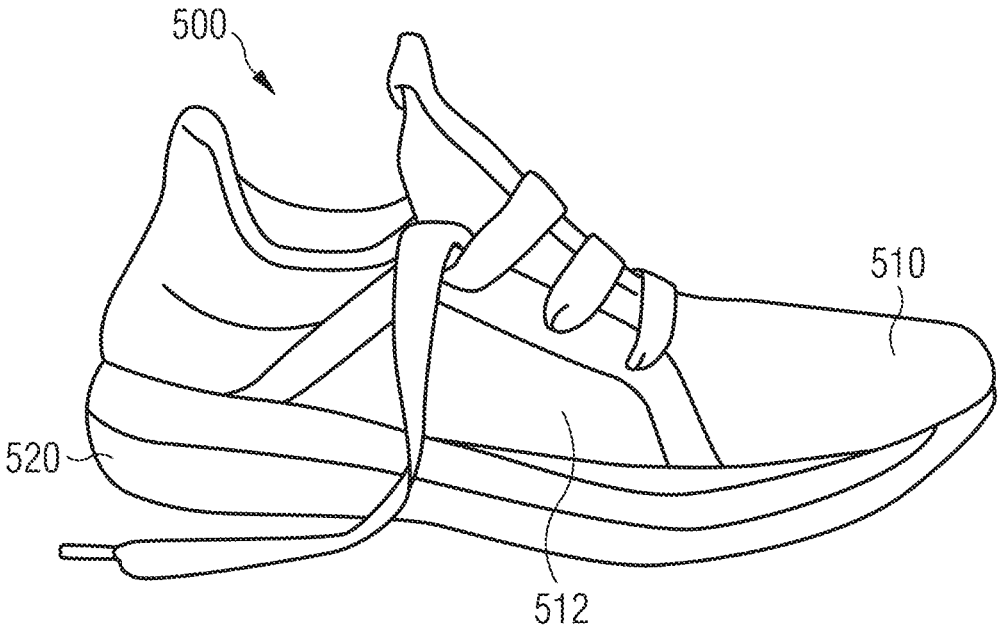
FIG. 6*b* is a side view of the shoe of FIG. 6*a*.

FIGS. 6*a-b* show two further embodiments of an inventive shoe 500. The statements made with regard to the shoes 100 and 300 apply analogously to the shoe 500.

The shoe 500 comprises an upper 510 and a sole unit 520. The upper 510 is attached to the sole unit 520 such that in a midfoot region of the shoe 500 there is a gap between a lower side of the upper 510 and a top side of the sole unit 520.

In the embodiments shown in FIG. 6*a*, the shoe 500 does not comprise a reinforcing element in the adaptive region.

As shown in FIG. 6*b*, the gap between the upper 510 and the sole unit 520 of an inventive shoe 500 may be covered on the medial and/or lateral side of the shoe 500 by a respective panel 512 of the upper 510. The panels 512 may prevent the ingress of stones, water or dirt into the gap. However, it should be noted that the gap still provides a degree of independence of movement between the upper 510 and the sole unit 520 despite the entrance to the gap being covered in this way. Alternatively, another implementation of forming a barrier to the ingress of matter could be employed, for example, a net or a foil could be used instead of the panels 512. Again, in some embodiments, the embodiments used should permit a degree of independence of movement between the sole and the lower part of the upper.

Figure 7A:
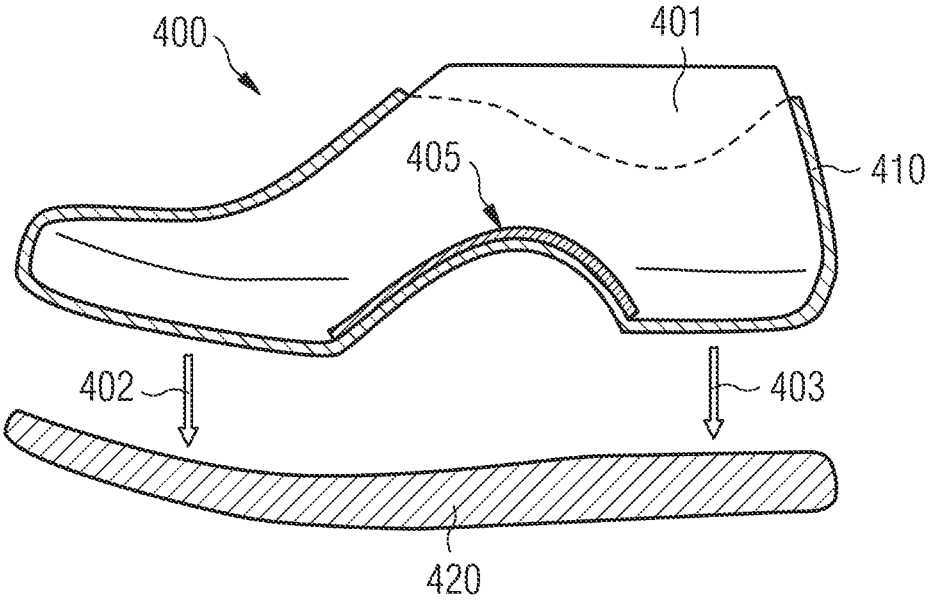
FIG. 7*a* is a side view of a shoe, according to certain embodiments of the present invention.
Figure 7B:
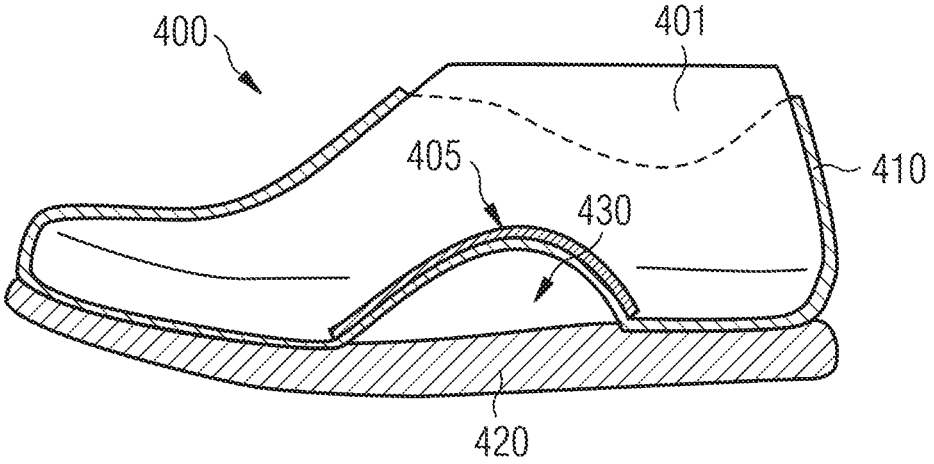
FIG. 7*b* is a side view of the shoe of FIG. 7*a*.
Figure 7C:
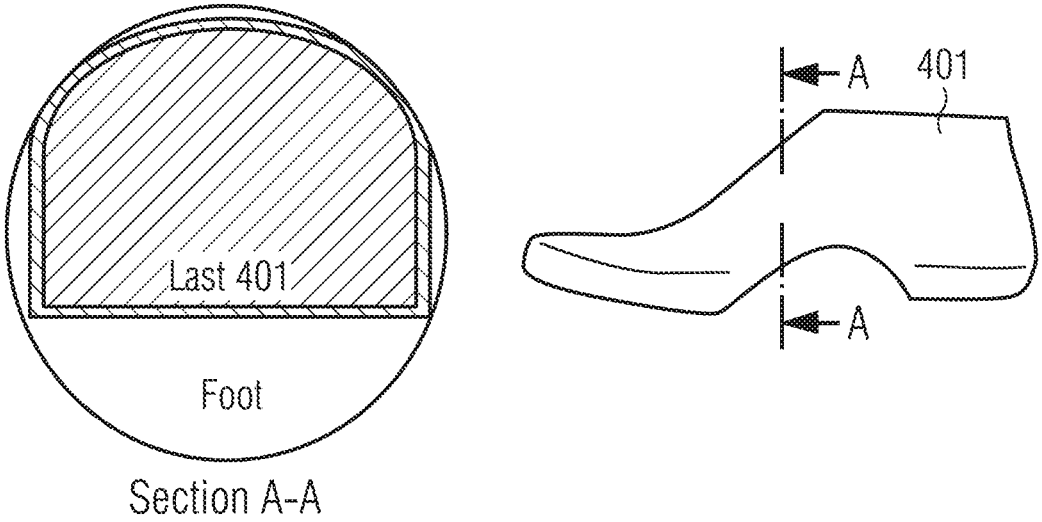
FIG. 7*c* is a cross-sectional view of the shoe of FIG. 7*a*.

FIGS. 7*a-c* show embodiments of a method 400 according to the invention for the manufacture of a shoe, for example the shoe 100, 300 or 500. The method 400 comprises the following steps: First, an upper 410, e.g. one of the uppers 110, 310 or 510, is mounted on a last 401. For example, the upper 410 is slid onto the last 401. The upper 410 is then connected to a sole unit 420, for example one of the sole units 120, 320 or 520, only in a forefoot region and a heel region, as indicated by the arrows 402 and 403 in FIG. 7*a*. The connection is effected in such a manner that in a midfoot region there is a gap 430 between a lower side of the upper 410 and a top side of the sole unit 420, as shown in FIG. 7*b*.

In the embodiments shown in FIGS. 7*a-c*, the last 401 comprises a concave shape 405 in the midfoot region. The shape 405 may be in correspondence with the arch of a foot of a user.

During the connecting, the upper 410 may abut the last 401 in the midfoot region. With a suitable design of the concave region 405 of the last 401, the desired degree of predetermined tension may be imparted to the upper 410 in the manufactured shoe in order to achieve the desired fit.

The amount of pre-tension imparted to the upper 410 in the manufacture of the shoe may also be adjusted and influenced by varying the ratio of the cross-sectional area of the last 401 in the region of the gap and the cross-sectional area of the foot of a user in the corresponding region. This concept is illustrated in FIG. 7*c*. With regard to a cross-sectional plane A-A arranged in the midfoot region where the gap is located, and with the longitudinal direction (i.e. the direction from the heel to the toes) of the shoe is approximately perpendicular to the plane A-A, the last 401 comprises a smaller cross-sectional area than the foot, as shown in the left half of FIG. 7*c*. The cross-sectional area of the last 401 may for example be 0.8 times the cross-sectional area of an average foot, or 0.7 times the cross-sectional area of an average foot, or 0.6 times the cross-sectional area of an average foot, or 0.5 times the cross sectional area of an average foot.

In some embodiments, the sole unit 420 may comprise particles of expanded thermoplastic polyurethane (eTPU), and/or of expanded polyetherblockamide (ePEBA), and/or of expanded polyamide (ePA). The particles may be connected to each other, for example at their surfaces, and they may be randomly arranged. The connection of particles may be achieved during the method 400, for example by adding a binding agent. Or the particles are welded to each other during the method 400 by providing heat energy to them, for example in the form of steam.

Figure 8:
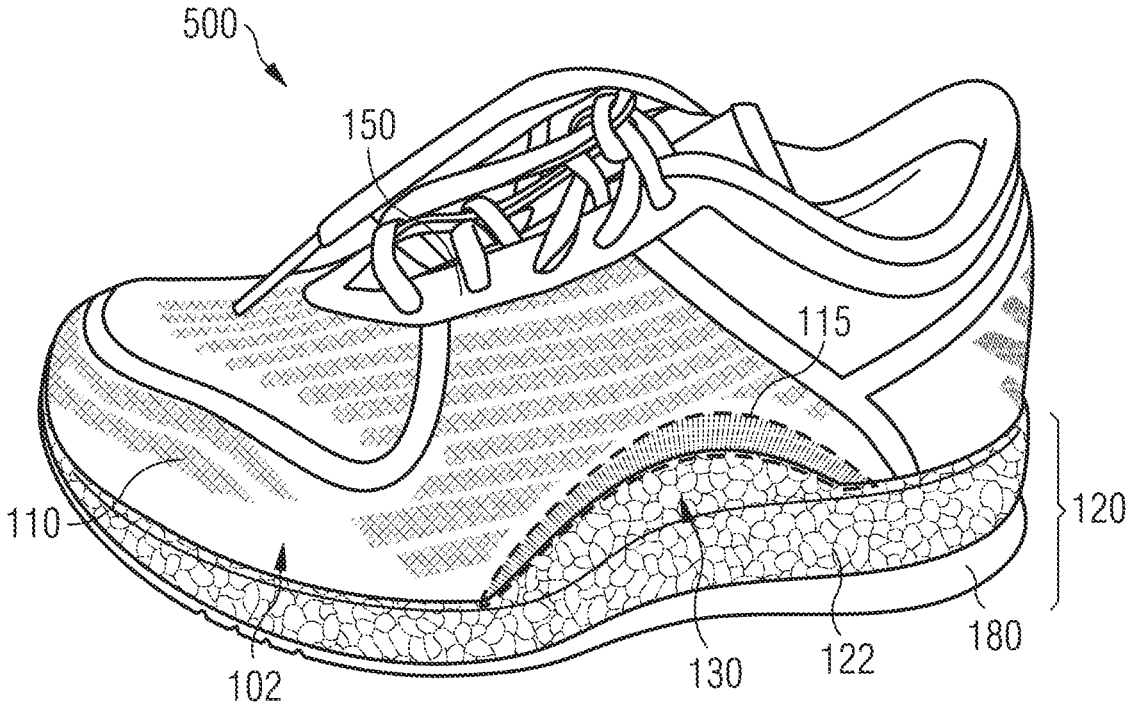
FIG. 8 is a perspective view of a shoe, according to certain embodiments of the present invention.

FIG. 8 shows a lateral side view 102 of embodiments of a shoe 500 that are similar to shoe 100 as described above.

The shoe 500 comprises an upper 110 and a sole unit 120, wherein the upper 110 is attached to the sole unit 120 such that in a midfoot region of the shoe 500 there is a gap 130 between a lower side 115 of the upper 110 and a top side of the sole unit 120. The sole unit 120 may have a midsole 122 and an outsole 180. In addition, shoe 500 may comprise a lacing element 150.

In the shoe 500, the material of the upper 110 may be different in the midfoot region compared to the heel region and/or the forefoot region of the upper, wherein the different material may be restricted to the lower side 115 of the upper above the gap 130. In some embodiments, the different material is located on the lower side 115 and a portion of one or more additional areas of the upper 110. One example of the different material may be seen in FIG. 8 showing a white material (indicated with a dashed shape) on the lower side 115 in the midfoot region and a light grey material in the heel and forefoot region. As a result, the different material may provide different characteristics which are optimized for the adaptive region in the midfoot region. There may be more than one different material used in the midfoot region.

Using different materials also allows for optimizing a part or all of the other regions of the upper 110 to other technical characteristics. For example, the midfoot region may be manufactured to be a piece providing a higher rigidity for an increased support of the arch of the user of the shoe. By contrast, the other regions of the upper in the forefoot and/or the heel region may for example be more flexible and elastic to improve the wearing comfort. Alternatively or additionally, such regions may have a higher tensile strength to provide increased support for lateral sports such as tennis or hockey with many lateral movements of the foot.

In the following, further examples are described to facilitate the understanding of the invention:

Example 1

Shoe, in particular a running shoe, comprising:

a. an upper; and b. a sole unit, wherein c. the upper is attached to the sole unit such that in a midfoot region there is a gap between a lower side of the upper and a top side of the sole unit.

Example 2

Shoe according to the preceding example, wherein the gap extends from a lateral side of the shoe to a medial side of the shoe.

Example 3

Shoe according to any one of the preceding examples, wherein the upper is attached to the sole unit in a heel region and a forefoot region and wherein the heel region is a minimum of 15% of the longitudinal shoe length from the rear of the shoe and the forefoot region is a minimum of 20% of the longitudinal shoe length from the front of the shoe.

Example 4

Shoe according to any one of the preceding examples, wherein the gap has a longitudinal extension up to 20 cm, in particular in the range of 2 cm-10 cm.

Example 5

Shoe according to any one of the preceding examples, wherein the gap extends essentially over the length of the arch of a foot of a user.

Example 6

Shoe according to the preceding example 5, wherein in the midfoot region the lower side of the upper has a shape configured to adapt to a lower side of the arch of the foot of the user.

Example 7

Shoe according to any one of the preceding examples, wherein in the midfoot region where the gap is located the upper is configured to allow a minimum strain of 5% in both the medial-lateral direction and the forefoot-to-rearfoot direction and/or wherein in the midfoot region where the gap is located the upper is configured to allow a maximum strain of 150% in both the medial-lateral direction and the forefoot-to-rearfoot direction.

Example 8

Shoe according to the preceding example 7, wherein the strain is in part comprised of a strain imparted to the upper during manufacture of the upper.

Example 9

Shoe according to any one of the preceding examples, wherein a material of the upper comprises an elastic content, in particular at least one of: a natural material, a synthetic material, synthetic fibres, synthetic leather, thermoplastic polyurethane, leather, cotton, elastane fibres.

Example 10

Shoe according to any one of the preceding examples, wherein the upper comprises a knitted material, in particular at least one of: a circular knitted material, a flat knit material, a warp knit material, and/or wherein the upper comprises an engineered mesh.

Example 11

Shoe according to any one of the preceding examples, wherein in the midfoot region the lower side of the upper is seamless.

Example 12

Shoe according to any one of the preceding examples, wherein the upper encompasses the arch of a foot of a user.

Example 13

Shoe according to any one of the preceding examples, wherein the upper comprises at least one reinforcing element extending from a medial side of the instep around the lower side of the upper to a lateral side of the instep.

Example 14

Shoe according to the preceding example 13, wherein the reinforcing element connects to or is integrated with a lacing system of the shoe on the medial and the lateral side of the instep.

Example 15

Shoe according to any one of the preceding examples 13 or 14, wherein the reinforcing element comprises a flexible and tear resistant material, in particular at least one of the following: a textile material, a synthetic material, a synthetic hybrid material, polyurethane, thermoplastic polyurethane, polyamide, polyethylene, polypropylene.

Example 16

Shoe according to any one of the preceding examples 13-15, wherein the reinforcing element comprises at least one of: a webbing, a stretchable webbing, a non-stretch webbing, a mesh.

Example 17

Shoe according to any one of the preceding examples 13-16, wherein the reinforcing element is printed or welded or stitched to a fabric of the upper.

Example 18

Shoe according to any one of the preceding examples 1-17, wherein the upper further comprises a lacing element extending from a heel region to a lateral and/or a medial side of the instep and connecting to a lacing system of the shoe.

Example 19

Shoe according to the preceding example 18, wherein the lacing element is integrally provided as one piece and extends from the medial side of the instep around the heel to the lateral side of the instep.

Example 20

Shoe according to any one of the preceding examples, wherein the shoe comprises an insole which is not connected to the upper in the midfoot region.

Example 21

Shoe according to the preceding example 20, wherein the insole is connected to the upper in a heel region and in a forefoot region.

Example 22

Shoe according to any one of the preceding examples, wherein the sole unit comprises particles of an expanded material, in particular particles of at least one of: expanded thermoplastic polyurethane, expanded polyetherblockamide, expanded polyamide.

Example 23

Shoe according to any one of the preceding examples, wherein the sole unit comprises a support element, in particular a support element to enhance the ability to limit overpronation and/or underpronation.

Example 24

Method for the manufacture of a shoe, in particular a running shoe, comprising the following steps:

a. mounting an upper on a last; and b. connecting the upper to a sole unit only in a forefoot region and a heel region, such that in a midfoot region there is a gap between a lower side of the upper and a top side of the sole unit.

Example 25

Method according to the preceding example 24, wherein in the midfoot region the last comprises a concave shape and wherein during step b, the upper abuts the last in the midfoot region.

Example 26

Method according to any one of the preceding examples 24 or 25, wherein the last comprises a smaller cross-sectional area than the foot of a user with respect to a cross-sectional plane (A-A) arranged in the midfoot region where the gap is located and with the longitudinal direction of the shoe is approximately perpendicular to the sectional plane.

Example 27

Method according to one of the preceding examples 24-26, wherein the sole unit comprises particles of an expanded material, in particular particles of at least one of: expanded thermoplastic polyurethane, expanded polyether-blockamide, expanded polyamide.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sporting shoe for running and sporting comprising:

a) an upper comprising an upper surface and a lower textile surface; and b) a sole unit comprising an outsole extending from a forefoot region to a heel region and attached to the lower textile surface of the upper around at least the outer edges of the sole in the forefoot region and the heel region except in a detached region in a midfoot region;

wherein the forefoot region extends from the midfoot region to a frontmost edge and from a lateral edge to a medial edge of the sole unit;

wherein the heel region extends from the midfoot region to a rearmost edge and from the lateral edge to the medial edge of the sole unit;

wherein the lower textile surface of the upper is directly attached to the sole unit in the forefoot region and the heel region of the shoe to form two directly attached regions;

wherein the lower textile surface of the upper is detached from the sole unit in a midfoot region between the two directly attached regions to form the detached region, and is adapted to conform to an arch of a foot of a user; and wherein the detached region forms a substantially horizontal opening that passes, in a longitudinal direction, below the lower textile surface of the upper and above the sole unit in the midfoot region.

2. The shoe of claim 1, wherein:

the upper comprises a first material in the midfoot region and a second material in the heel region, wherein the second material comprises at least one physical property that is different compared to the first material; and the first material in the midfoot region is disposed at least on the lower textile surface of the upper.

3. The shoe of claim 1, wherein:

the upper comprises a first material in the midfoot region and a second material in the forefoot region, wherein the second material comprises at least one physical property that is different compared to the first material; and the first material in the midfoot region is disposed at least on the lower textile surface of the upper.

4. The shoe of claim 1, wherein a location of the detached region is configured to allow a minimum strain of 5% in both a medial-lateral direction and a forefoot-to-rearfoot direction.

5. The shoe of claim 1, wherein, in the midfoot region where the opening is located, the upper is configured to allow a maximum strain of 150% in both a medial-lateral direction and a forefoot-to-rearfoot direction.

6. The shoe of claim 1, wherein the lower textile surface of the upper in the midfoot region is seamless.

7. The shoe of claim 2, wherein the first material is selected to provide higher rigidity and is configured to provide increased support to the arch of the foot of the user than the second material.

8. The shoe of claim 1, wherein:

the upper comprises at least one reinforcing element disposed within the opening; and the at least one reinforcing element extends from a medial side of the shoe around the lower textile surface of the upper to a lateral side of the shoe;

at least a portion of the at least one reinforcing element is fixedly connected to the lower textile surface of the upper such that the at least one reinforcing element is an outermost surface of the upper adjacent to the opening; and the at least one reinforcing element connects to or is integrated with a lacing system of the shoe on the medial and the lateral side of the shoe.

9. The shoe of claim 1, wherein the upper further comprises a lacing element extending from the heel region to a lateral side of an instep and connecting to a lacing system of the shoe.

10. The shoe of claim 9, wherein the lacing element is integrally provided as one piece and extends from a medial side of the instep around a heel to the lateral side of the instep.

11. The shoe of claim 1, wherein the upper further comprises a lacing element extending from the heel region to a medial side of an instep and connecting to a lacing system of the shoe.

12. The shoe of claim 11, wherein the lacing element is integrally provided as one piece and extends from the medial side of the instep around a heel to a lateral side of the instep.

13. The shoe of claim 1, wherein the shoe further comprises an insole, and wherein the insole is directly attached to the lower textile surface of the upper in the forefoot region and the heel region of the shoe, and wherein the insole is detached from the upper in the midfoot region between the two directly attached regions.

14. The shoe of claim 1, wherein the sole unit comprises a support element embedded within the sole unit, wherein:

the support element comprises an elongated member extending in a direction parallel to a longitudinal direction of the shoe; and the support element is configured to limit at least one of overpronation or underpronation.

15. A shoe comprising:

an upper, wherein the upper comprises an upper surface and a lower textile surface;

a sole unit comprising a midsole and an outsole; and a lacing element:

wherein the lower textile surface of the upper is directly attached to the sole unit in a forefoot region and a heel region of the shoe around at least the outer edges of the sole to form two directly attached regions, wherein the forefoot region extends from the midfoot region to a frontmost edge and from a lateral edge to a medial edge of the sole unit;

wherein the heel region extends from the midfoot region to a rearmost edge and from the lateral edge to the medial edge of the sole unit;

wherein the lower textile surface of the upper is detached from the sole unit in the midfoot region between the two directly attached regions;

wherein the detached region forms a substantially horizontal opening that passes, in a longitudinal direction, below the lower textile surface of the upper and above the sole unit in the midfoot region, and is adapted to conform to an arch of a foot of a user;

wherein the outsole extends from a forefoot region to a heel region, and the midfoot region of the upper comprises a material with different physical properties compared to a material of a heel region and a forefoot region of the upper.

16. The shoe of claim 1, wherein a shape of the upper is configured to conform to at least a portion of the lower surface of the foot when worn.

17. The shoe of claim 1, wherein:

the upper abuts the foot of the user on all sides of the foot when worn; and a length and width of the sole unit correspond to a length and width of the lower textile surface of the upper, respectively.

18. The shoe of claim 8, wherein the at least one reinforcing element defines an upper edge of the opening and the sole unit defines a lower edge of the opening.

19. The shoe of claim 1, wherein the sole unit is attached to all portions of the lower textile surface of the upper except for an area configured to correspond to the arch of the foot of the user.

20. The shoe of claim 1, wherein the upper further comprises a lacing element configured to be disposed between the lower textile surface and at least a portion of the lower surface of the foot of the user when worn.

* * * * *